US011406191B2

(12) United States Patent
Chen et al.

(10) Patent No.: US 11,406,191 B2
(45) Date of Patent: Aug. 9, 2022

(54) IRON SOFA FRAME STRUCTURE, SOFA AND PRODUCTION METHOD THEREOF

(71) Applicant: Remacro Technology Co., Ltd., Suzhou (CN)

(72) Inventors: Weiming Chen, Jiangsu (CN); Xiaohong Li, Jiangsu (CN)

(73) Assignee: Remacro Technology Co., Ltd., Suzhou (CN)

( * ) Notice: Subject to any disclaimer, the term of this patent is extended or adjusted under 35 U.S.C. 154(b) by 0 days.

(21) Appl. No.: 17/257,305

(22) PCT Filed: Jul. 10, 2020

(86) PCT No.: PCT/CN2020/101189
§ 371 (c)(1),
(2) Date: Dec. 31, 2020

(87) PCT Pub. No.: WO2021/008440
PCT Pub. Date: Jan. 21, 2021

(65) Prior Publication Data

US 2021/0353064 A1 Nov. 18, 2021

(30) Foreign Application Priority Data

Jul. 15, 2019 (CN) ..... 201910637243.9
Oct. 9, 2019 (CN) ..... 201910952038.1

(51) Int. Cl.
*A47C 1/035* (2006.01)
*A47C 1/0355* (2013.01)
(Continued)

(52) U.S. Cl.
CPC ..... *A47C 1/0355* (2013.01); *A47C 5/04* (2013.01); *A47C 17/04* (2013.01)

(58) Field of Classification Search
CPC ..... A47C 5/04; A47C 17/04; A47C 1/0355; A47C 1/035
See application file for complete search history.

(56) References Cited

U.S. PATENT DOCUMENTS 5,080,438 A * 1/1992 Moyer ..... A47C 4/028 297/440.23
5,765,913 A * 6/1998 LaPointe ..... A47C 1/035 248/370

(Continued)

FOREIGN PATENT DOCUMENTS

CN 101879014 A 11/2010
CN 203676561 U 7/2014

(Continued)

*Primary Examiner* — Shin H Kim

(57) ABSTRACT

Provided is an iron sofa frame structure provided with a base, two supporting plates oppositely disposed, configured to support a soft package and be connected with a sofa fabric and two driving link sets respectively configured to connect the two supporting plates to the base, wherein a front rod and a rear rod are correspondingly disposed at intervals between the two supporting plates, and several elastic bearing pieces for bearing the soft package are disposed between the front rod and the rear rod. The supporting assembly is directly combined to the iron sofa frame structure, so that a structure in which an additional seat-wrapped frame is introduced to support the soft package is rejected, an existing iron sofa frame structure and a production process of an iron sofa frame are simplified, the assembling and production efficiencies are increased, materials are saved, and the cost is reduced.

35 Claims, 25 Drawing Sheets

(51) Int. Cl.
*A47C 5/04* (2006.01)
*A47C 17/04* (2006.01)

(56) References Cited

U.S. PATENT DOCUMENTS

| | | | | |
|---|---|---|---|---|
| 6,234,578 | B1 | 5/2001 | Barton et al. | |
| 7,040,700 | B2 * | 5/2006 | Duncan | A47C 7/54 297/229 |
| 8,113,574 | B2 * | 2/2012 | Hoffman | A47C 3/18 297/85 L |
| 8,398,168 | B2 * | 3/2013 | Lawson | A47C 1/0355 297/259.2 |
| 2006/0273631 | A1 * | 12/2006 | White | A47C 1/0355 297/85 L |
| 2011/0175426 | A1 * | 7/2011 | Lawson | A47C 1/0355 297/85 M |
| 2016/0088942 | A1 * | 3/2016 | Murphy | A47C 1/0345 297/361.1 |
| 2021/0353064 | A1 * | 11/2021 | Chen | A47C 31/023 |

FOREIGN PATENT DOCUMENTS

| | | | |
|---|---|---|---|
| CN | 111248680 | A | 6/2020 |
| CN | 111248681 | A | 6/2020 |
| CN | 111265048 | A | 6/2020 |
| CN | 111265049 | A | 6/2020 |
| CN | 210842329 | U | 6/2020 |

* cited by examiner

IRON SOFA FRAME STRUCTURE, SOFA AND PRODUCTION METHOD THEREOF

FIELD OF THE INVENTION

The present invention relates to the technical field of furniture and in particular to an iron sofa frame structure, a sofa and a production method thereof.

BACKGROUND OF THE INVENTION

The furniture industry belongs to the traditional labor-intensive industry all the time, and it needs a lot of labor and production material in a production process and is low in production efficiency. For example, iron frames of sofas, forming main force bearing parts of current functional sofas, generally adopt seat-wrapped frames as supporting structures of soft packages, and most of the seat-wrapped frames are made of solid woods or iron frames.

A wooden seat-wrapped frame is the most common, and the wooden seat-wrapped frame is mounted for achieving the effects of increasing the supporting area of the soft package, improving the comfort level and prolonging the service life of the soft package and has the advantages of light weight and convenience in connection. When the wooden seat-wrapped frame is fabricated, firstly, a seat-wrapped frame is erected by using a solid wood in a wood plant, two girders of the wooden seat-wrapped frame are respectively and correspondingly provided with hooks for connecting serpentine springs, and the hooks are fixedly disposed on the wooden seat-wrapped frame by using rivets or screws; and after the fabrication of the wooden seat-wrapped frame is completed, the wooden seat-wrapped frame is transported to a sofa assembly workshop in which the serpentine springs are mounted on the wooden seat-wrapped frame, and then, the wooden seat-wrapped frame is assembled on the iron sofa frame, and the sofa fabric wrapping the soft package is fixed on the wooden seat-wrapped frame through rivets. The wooden seat-wrapped frame is adopted as the supporting structure of the soft package, and the connection between the hooks/the sofa fabric and the seat-wrapped frame is more convenient and the connection point is not limited, the rivets or the screws are struck into any position on the wooden seat-wrapped frame to fix the hooks and the sofa fabric. Such an iron sofa frame is easy to process and simple in production process, a sofa may be assembled by using a traditional manual production line, and therefore, the production process of the sofa is suitable for the traditional furniture industry. However, the wooden seat-wrapped frame has the non-negligible defects that: (1) the consumption of wood resources is high, which does not conform to the proposal of environment protection; (2) pests are easy to reproduce on woods to result in poor use experience and short service life, export inspection of the woods is required during export, and if single sampling inspection does not meet a requirement, the whole batch of sofas is required to be detained or repatriated, which is unfavorable to international trade; (3) a working process of connecting the wooden seat-wrapped frame to the iron sofa frame is additionally provided, and the connecting stability is poor, so that defects are easy to generate; (4) woods and metal parts are processed in different workshops, so that the transportation distance is increased, and the logistic cost of internal production is affected; (5) more manual production processes are adopted, so that it is inconvenient to realize standardized production, and the quality of the sofa may not be kept unified; (6) during production of the wooden seat-wrapped frame, it is difficult to handle dust generated by wood cutting, the production workshop is difficult to clean, the cleaning cost is high, the wood cutting difficulty is high, and the defective rate is high; and (7) the wooden seat-wrapped frame is mounted, leather or cloth is fixed on the wooden seat-wrapped frame by using the rivets, firm mounting is realized, but low efficiency, high rivet raw material and device costs and low error tolerant rate are caused, and therefore, if disassembly may not be realized due to error generation during mounting, a sofa fabric is easy to damage.

Now, there are some seat-wrapped frames made of iron frames. For example, Chinese patent CN101879014A ("Sofa Frame Convenient to Disassemble and Assemble and Small in Transportation Volume") discloses a sofa frame in which a seat-wrapped frame is provided with a connecting slot, each of a first rack body and a second rack body is correspondingly provided with a locating slot, and two ends of a snap-connecting and fixing unit are respectively in snap connection to the locating slots of the first rack body and the second rack body and the connecting slot of the seat-wrapped frame, so that the seat-wrapped frame is connected with the first rack body and the second rack body. An iron seat-wrapped frame is used as a supporting structure of a soft package, a connecting assembly for connecting the iron seat-wrapped frame to an iron sofa frame is required to be produced, moreover, all parts in the connecting assembly are respectively mounted on the iron seat-wrapped frame and the iron sofa frame, and then, the iron seat-wrapped frame and the iron sofa frame are mutually assembled, thereby causing the problems of increment of the parts of the iron sofa frame and complexity of an assembling process; a production process of the iron seat-wrapped frame and a production process of the connecting assembly are further required to be provided to cause the problems such as low production efficiency and high consumption of production material of the sofa, so that industrial optimization and cost reduction of enterprises may not be favorably realized, and certain adverse impacts on standardized and automatic production of the enterprises are brought; and a leather upholstering process of the iron seat-wrapped frame generally adopts a screw fixing way by which the assembly is troublesome, a fabric is easy to damage and fall off after being used for a long term, and the stability of the quality of a product is not favorably achieved.

Nowadays, traditional labor-intensive furniture enterprises will be subjected to huge impact on the globalized furniture market, and therefore, it is necessary to improve a structure and process of the iron sofa frame of the sofa, furthermore, the quality and production cost of the sofa may be controlled, and the standardized and automatic production of the sofa may be realized.

SUMMARY OF INVENTION

In order to overcome at least one defect in the prior art, the present invention provides an iron sofa frame structure to solve the problems of complex production process, high material consumption, low production efficiency and high cost of a current sofa.

Technical solutions adopted for solving the problems in the present invention are that:

an iron sofa frame structure is provided with a base, two supporting plates oppositely disposed, configured to support a soft package and be connected with a sofa fabric and two driving link sets respectively configured to connect the two supporting plates to the base, wherein a front rod and a rear rod are correspondingly disposed at intervals between the two supporting plates, and several elastic bearing pieces for bearing the soft package are disposed between the front rod and the rear rod.

According to the iron sofa frame structure provided by the present invention, the front rod and the rear rod are mounted between the two supporting plates in the iron sofa frame structure, the elastic bearing pieces are directly mounted by virtue of the front rod and the rear rod so as to be used as a main structure of a supporting assembly for supporting the soft package, and the supporting assembly is directly combined to the iron sofa frame structure, so that a structure in which an additional seat-wrapped frame is introduced to support the soft package is rejected, an existing iron sofa frame structure and a production process of an iron sofa frame are simplified, the assembling and production efficiencies are increased, materials are saved, and the cost is reduced.

Further, the supporting plates are hinged to the driving link sets.

Further, each of the supporting plates includes a panel for supporting the soft package and an inner side plate disposed on the panel, and the inner side plate is provided with several hinge points for hinging the driving link set.

Therefore, the supporting plates may be simultaneously connected with the soft package and the driving link sets by the panels and the inner side plates in the supporting plates; and the panel may increase the supporting area of the soft package, and the side edge of sponge in the soft package does not need to be processed, so that the material of the sponge is saved, the processing procedure of the sponge is omitted, and the production cost is reduced.

Further, the iron sofa frame structure further includes two oppositely disposed backrest assemblies, and the backrest assemblies are connected to the base and the inner side plates.

Further, each of the driving link sets includes a ninth link and a tenth link, each of the backrest assemblies includes a backrest bracket configured to be connected with a backrest frame of the sofa and a fixed link, two ends of the ninth link are respectively hinged to the inner side plate and the base, two ends of the tenth link are respectively hinged to the ninth link and the backrest bracket, one end of the backrest bracket is hinged with the inner side plate, one end of the fixed link is fixedly connected with the base, and the other end of the fixed link is hinged with the backrest bracket.

Therefore, the driving link sets and all the links of the backrest assemblies are combined with each other. When the supporting plates extend relative to the base, the ninth links lift upwards and forwards with the supporting plates, and the tenth links slightly lift upwards and forwards with the ninth links and drive the backrest brackets to be inclined backwards (that is, tilted backwards). Compared with the prior art, the number of parts of the driving link sets and the backrest assemblies in the present invention is obviously reduced, so that the difficulty of a production process is greatly lowered; and the links are simple in structure, so that external sizes of functional mechanisms in the iron sofa frame structure are reduced, the height of the iron frame is reduced, the occupied space is reduced, the comfort level is improved, and the aesthetic property of the overall sofa is improved.

Further, the iron sofa frame structure further includes two oppositely disposed leg telescoping assemblies, and the leg telescoping assemblies are connected to the inner side plates.

Further, the width of the panel is greater than 5 cm.

Therefore, the panel may be better supported at the side edge of the soft package to increase the supporting area of the soft package, improve the comfort level and prolong the service life of the soft package.

Further, the inner side plate is further provided with snap holes configured to connect connecting pieces on the sofa fabric.

Therefore, the inner side plates are adopted to be connected with the driving link sets and the connecting pieces on the sofa fabric, thereby saving materials of the supporting plates and reducing the cost and the weight.

Further, the inner side plate and the panel are inverted L-shaped, and the inner side plate and the panel are formed by integral bending.

Therefore, it is convenient to process the supporting plates, and the supporting plates are kept to have greater supporting strength.

Further, the bottom of the panel is further provided with an outer side plate for connecting the connecting pieces on the sofa fabric, and the inner side plate and the outer side plate are respectively located at the inner and outer sides of the lower surface of the panel.

Therefore, during leather upholstering, the soft package may be assembled by working personnel by snap connection of the connecting pieces on the sofa fabric to the outer side plate, the leather upholstering process is simple and convenient and easy to operate, bypassing the panel is not needed, and the sofa fabric wrapping the soft package and the panel are prevented from being worn.

Further, the inner side plate, the outer side plate and the panel are inverted U-shaped, and the inner side plate, the outer side plate and the panel are formed by integral bending.

Therefore, it is convenient to process the supporting plates, and the supporting plates are kept to have greater supporting strength.

Further, the elastic bearing pieces are serpentine springs, and the serpentine springs are detachably fixed on the front rod and the rear rod by fixing mechanisms.

Further, each of the fixing mechanisms includes a fixed end and a hook end which are connected, the outer side wall of each of the front rod and the rear rod is provided with several holes for inserting and fixing the fixed ends, the fixed ends of the fixing mechanisms are inserted into the holes of the front rod or the rear rod so as to be fixed, and the hook ends are disposed on the upper surface of the front rod or the rear rod and are connected with the serpentine springs.

Further, each of the fixed ends is of a Z-shaped structure.

Therefore, during use, the fixing mechanisms may be fixedly disposed on the front rod or the rear rod by the Z-shaped structures by virtue of pulling edges of the serpentine springs instead of screw fixing, so that the cost is reduced, and the assembling efficiency of the fixing mechanisms is increased.

Further, the fixing mechanisms are hooks, and the hooks are respectively and correspondingly disposed on the front rod and the rear rod and are connected with the serpentine springs.

Further, the hooks are provided with bulges for limiting the separation of the serpentine springs.

Therefore, due to the arrangement of the bulges on the hooks, the serpentine springs may be prevented from separating from the hooks during use. Moreover, when the serpentine springs are hooked and assembled, it is unnecessary to bend ends of the serpentine springs to strength the connection with the hooks, so that assembling steps of the serpentine springs are reduced, and the production efficiency is increased.

Further, the front rod is made of a metal material, the front rod includes two oppositely disposed first vertical plates and a first transverse plate connected with the two first vertical plates, and the hooks on the front rod are formed by integrally punching the first transverse plate.

Therefore, compared with hooks connected to the front rod in a welding or any other form in the prior art, the hooks formed by integral punching are higher in strength and not easier to damage under the pulling force of the serpentine springs, so that the step of welding the hooks is omitted, and the assembling process is simplified.

Further, the two first vertical plates and the first transverse plate are inverted U-shaped and are formed by integral bending.

Therefore, it is convenient to process the front rod, and the front rod is kept to have greater supporting strength.

Further, the rear rod is made of a metal material, the rear rod includes two oppositely disposed second vertical plates and a second transverse plate connected with the two second vertical plates, and the hooks on the rear rod are formed by integrally punching the second transverse plate.

Therefore, compared with hooks connected to the rear rod in a welding or any other form in the prior art, the hooks formed by integral punching are higher in strength and not easier to damage under the pulling force of the serpentine springs, so that the step of welding the hooks is omitted, and the assembling process is simplified.

Further, the two second vertical plates and the second transverse plate are inverted U-shaped and are formed by integral bending.

Therefore, it is convenient to process the rear rod, and the rear rod is kept to have greater supporting strength.

Based on the above, the iron sofa frame structure provided by the present invention has the following beneficial effects:

1) the front rod and the rear rod are mounted between the two supporting plates in the iron sofa frame structure, the elastic bearing pieces are directly mounted by virtue of the front rod and the rear rod so as to be used as a main structure of a supporting assembly for supporting the soft package, and the supporting assembly is directly combined to the iron sofa frame structure, so that a structure in which an additional seat-wrapped frame is introduced to support the soft package is rejected, an existing iron sofa frame structure and a production process of an iron sofa frame are simplified, the assembling and production efficiencies are increased, materials are saved, and the cost is reduced;

2) the front rod and the rear rod which are made of the metal material are high in connection strength and capable of conveniently realizing standardized and automatic production, so that the overall iron sofa frame structure may be produced in the same workshop, the logistic cost of internal production is reduced, and the production efficiency is further increased;

3) structures of original supporting plates in the iron sofa frame structure are optimized, the upper surfaces of the panels on the two supporting plates are utilized to support the soft package, so that the supporting area of the soft package is increased, the comfort level is improved, and the service life of the soft package is prolonged; and the side edge of sponge in the soft package does not need to be processed, so that the material of the sponge is saved, the processing procedure of the sponge is omitted, and the production cost is reduced;

4) when the sofa fabric is required to be fixed on the iron sofa frame structure, leather upholstering assembly of the sofa fabric may be completed by only mounting the connecting pieces to the sofa fabric and then respectively performing mutual snap connection between each of the connecting pieces and the inner side plate or the outer side plate of each of the two supporting plates, and an existing leather upholstering process in which a wooden frame is fixed by using rivets or an iron frame is fixed by using screws is changed, so that the mounting process is simple and convenient, and the mounting efficiency is greatly increased; moreover, the connection way is firmer, disassembly is easy to realize, and the sofa fabric may not be damaged; and meanwhile, the error-tolerant rate in the mounting process is high;

5) the two supporting plates, the front rod and the rear rod are all shaped like inverted L or inverted U formed by integral bending so as to be higher in supporting strength and convenient to process, and furthermore, the overall supporting strength of the supporting assembly is improved; and the thicknesses and weights of the supporting plates, the front rod and the rear rod may be reduced on the premise that the overall supporting strength of the supporting assembly meets a use requirement, so that the overall weight and material cost of the iron sofa frame are reduced;

6) compared with the hooks connected to the front rod and the rear rod in a welding or any other form in the prior art, the hooks formed by integral punching on the front rod and the rear rod are higher in strength and not easier to damage under the pulling force of the serpentine springs, so that the service life of the iron sofa frame is prolonged, the step of welding the hooks is omitted, and the assembling process is simplified; and 7) due to the arrangement of the bulges on the hooks, the serpentine springs may be prevented from separating from the hooks during use. Moreover, when the serpentine springs are hooked and assembled, it is unnecessary to bend ends of the serpentine springs to strength the connection with the hooks, so that assembling steps of the serpentine springs are reduced, and the production efficiency is increased.

The present invention further provides a sofa, including:

an iron sofa frame structure, wherein the iron sofa frame structure is provided with a base, two supporting plates oppositely disposed, configured to support a soft package and be connected with a sofa fabric, two driving link sets respectively configured to connect the two supporting plates to the base, two backrest assemblies oppositely disposed and configured to connect the base and the supporting plates and two leg telescoping assemblies oppositely disposed and connected to the supporting plates, a front rod and a rear rod are correspondingly disposed at intervals between the two supporting plates, and several elastic bearing pieces for bearing the soft package are disposed between the front rod and the rear rod;

the soft package, disposed on the elastic bearing pieces;

the sofa fabric, wrapping the surface of the soft package and being in snap connection with the two supporting plates;

a backrest frame, disposed on the two backrest assemblies;

a footrest frame, disposed on the two leg telescoping assemblies; and two armrest frames, respectively disposed at the left and right sides of the iron sofa frame structure.

According to the sofa provided by the present invention, the front rod and the rear rod are mounted between the two supporting plates in the iron sofa frame structure, the elastic bearing pieces are directly mounted by virtue of the front rod and the rear rod so as to be used as a main structure of a supporting assembly for supporting the soft package, then, the soft package is mounted on the supporting assembly, and the sofa fabric wraps the surface of the soft package and is in snap connection with the two supporting plates, so that the mounting of a cushion is completed, the structure of an existing iron sofa frame and the overall production process of the sofa are simplified, and the amount of material and the cost are reduced. In addition, it is convenient to realize standardized and automatic production, and the assembling and production efficiencies are increased.

Further, the supporting plates are hinged to the driving link sets.

Further, each of the supporting plates includes a panel for supporting the soft package and an inner side plate disposed on the panel, and the inner side plate is provided with several hinge points for hinging the driving link set.

Therefore, the supporting plates may be simultaneously connected with the soft package and the driving link sets by the panels and the inner side plates in the supporting plates; and the panel may increase the supporting area of the soft package, and the side edge of sponge in the soft package does not need to be processed, so that the material of the sponge is saved, the processing procedure of the sponge is omitted, and the production cost is reduced.

Further, each of the leg telescoping assemblies includes a main footrest link and a leg link set, and the main footrest link is hinged to the inner side plate by the leg link set.

Further, each of the backrest assemblies includes a backrest bracket, a backrest supporting bracket and a backrest link set, and the backrest bracket is connected to the inner side plate and the base by the backrest supporting bracket and the backrest link set.

Further, each of the driving link sets includes a ninth link and a tenth link, each of the backrest assemblies includes the backrest bracket configured to be connected with the backrest frame of the sofa and a fixed link, two ends of the ninth link are respectively hinged to the inner side plate and the base, two ends of the tenth link are respectively hinged to the ninth link and the backrest bracket, one end of the backrest bracket is hinged with the inner side plate, one end of the fixed link is fixedly connected with the base, and the other end of the fixed link is hinged with the backrest bracket.

Therefore, the driving link sets and all the links of the backrest assemblies are combined with each other. When the supporting plates retract relative to the base, the ninth links lift upwards and forwards with the supporting plates, and the tenth links slightly lift upwards and forwards with the ninth links and drive the backrest brackets to be inclined backwards (that is, tilted backwards). Compared with the prior art, the number of parts of the driving link sets and the backrest assemblies in the present invention is obviously reduced, so that the difficulty of a production process is greatly lowered; and the links are simple in structure, so that external sizes of functional mechanisms in the iron sofa frame structure are reduced, the height of the iron frame is reduced, the occupied space is reduced, the comfort level is improved, and the aesthetic property of the overall sofa is improved.

Further, edges of the sofa fabric are provided with several connecting pieces configured to be in snap connection with the two supporting plates.

Therefore, when the sofa fabric is assembled, firstly, the surface of the soft package is wrapped with the sofa fabric, and then, the connecting pieces on the sofa fabric are respectively in mutual snap connection with the two supporting plates, in this way, leather upholstering assembly of the sofa fabric may be completed, a cushion is mounted, and an existing leather upholstering process in which a wooden frame is fixed by using rivets or an iron frame is fixed by using screws is changed, so that the mounting process is simple and convenient, and the mounting efficiency is greatly increased; moreover, the connection way is firmer, disassembly is easy to realize, and the sofa fabric may not be damaged; and meanwhile, the error-tolerant rate in the mounting process is high.

Further, the connecting pieces are snaps or snap bars.

Further, the inner side plate is further provided with snap holes for connecting the connecting pieces. In the solution, the inner side plates may be simultaneously connected with the sofa fabric and the driving link sets, thereby saving materials of the supporting plates and reducing the cost and the weight; and during leather upholstering, the connecting pieces on the sofa fabric may be snapped in the snap holes so as to be convenient to assemble and disassemble.

Further, the panel is further provided with an outer side plate, the inner side plate and the outer side plate are respectively located at the inner and outer sides of the lower surface of the panel, and the connecting pieces are snapped on the lower edge of the outer side plate. In the solution, the soft package may be assembled by directly snapping the connecting pieces on the sofa fabric on the lower edge of the outer side plate, and the connection way is rapid and convenient, and the snap holes are not needed, so that a procedure of processing the supporting plates is omitted; and the leather upholstering process is simple and convenient and easy to operate, bypassing the panel is not needed, and the sofa fabric wrapping the soft package and the panel are prevented from being worn.

Further, the elastic bearing pieces are serpentine springs, and the serpentine springs are detachably fixed on the front rod and the rear rod by fixing mechanisms.

Therefore, the serpentine springs are detachably connected with the front rod and the rear rod by the fixing mechanisms, so that it is convenient to assemble the serpentine springs.

Further, each of the fixing mechanisms includes a fixed end and a hook end which are connected, the outer side wall of each of the front rod and the rear rod is provided with several holes for inserting and fixing the fixed ends, the fixed ends of the fixing mechanisms are inserted into the holes of the front rod or the rear rod so as to be fixed, and the hook ends are disposed on the upper surface of the front rod or the rear rod and are connected with the serpentine springs.

Therefore, the fixed ends are inserted into the holes of the front rod and the rear rod to complete the fixation of the fixing mechanisms, and thus, it is convenient to assemble and disassemble the fixing mechanisms.

Further, the fixing mechanisms are hooks, and the hooks are respectively and correspondingly disposed on a first transverse plate of the front rod and a second transverse plate of the rear rod and are connected with the serpentine springs.

Further, the hooks are provided with bulges for limiting the separation of the serpentine springs.

Therefore, due to the arrangement of the bulges on the hooks, the serpentine springs may be prevented from separating from the hooks during use. Moreover, when the serpentine springs are hooked and assembled, it is unnecessary to bend ends of the serpentine springs to strength the connection with the hooks, so that assembling steps of the serpentine springs are reduced, and the production efficiency is increased.

Further, each of the front rod and the rear rod is made of a metal material, the front rod includes two oppositely disposed first vertical plates and the first transverse plate connected with the two first vertical plates, the rear rod includes two oppositely disposed second vertical plates and a second transverse plate connected with the two second vertical plates, the hooks on the first transverse plate are formed by integrally punching the first transverse plate, and the hooks on the second transverse plate are formed by integrally punching the second transverse plate.

Therefore, compared with hooks connected to the front rod and the rear rod in a welding or any other form in the prior art, the hooks formed by integral punching are higher in strength and not easier to damage under the pulling force of the serpentine springs, so that the service life of the iron sofa frame is prolonged, the step of welding the hooks is omitted, and the assembling process is simplified.

The present invention further provides a production method of a sofa, including the following steps:

producing an iron sofa frame according to a limited size, and assembling the iron sofa frame to obtain the iron sofa frame;

mounting serpentine springs on the iron sofa frame;

wrapping upsides of the serpentine springs on the iron sofa frame with a soft package;

processing a sofa fabric according to a set size, fixing connecting pieces at edges of the sofa fabric, then, mounting the sofa fabric on the soft package, and fixing the sofa fabric on the iron sofa frame by using the connecting pieces to complete the production of a sofa cushion part; and mounting a backrest frame, a footrest frame and two armrest frames on the iron sofa frame to complete the production of the sofa.

Further, the step of producing an iron sofa frame according to a limited size, and assembling the iron sofa frame to obtain the iron sofa frame further includes the following steps:

producing a base, two supporting plates and two driving link sets according to limited sizes, and completing assembly to obtain a functional rack of the iron sofa frame; and producing a front rod and a rear rod according to limited sizes, and correspondingly disposing the front rod and the rear rod at intervals between the two supporting plates to obtain the iron sofa frame, wherein the two supporting plates are interconnected with the front rod and the rear rod to form a main structure of the supporting assembly frame.

Further, the serpentine springs are mounted between the front rod and the rear rod, and the two supporting plates, the front rod, the rear rod and elastic bearing pieces form a main structure of a supporting assembly for supporting the soft package.

Further, the middle of the bottom of the soft package is provided with a groove matched with a spring surface formed by the elastic bearing pieces, and two sides of the bottom of the soft package are respectively abutted with the upper surfaces of the two supporting plates.

Further, the connecting pieces are snap bars, and the snap bars are respectively in snap connection to lower edges of outer side plates of the supporting plates.

Further, the snap bars may be further respectively in snap connection to lower edges of the first vertical plates at the outer side of the front rod and lower edges of the second vertical plates at the outer side of the rear rod.

Based on the above, the production method of the sofa, provided by the present invention, has the following beneficial effects that:

the production method of the sofa, provided by the present invention, breaks the production and assembly concepts of a traditional sofa, the two supporting plates respectively hinged to one end of each of the two driving link sets are combined with the front rod and the rear rod to form the main structure of the supporting assembly frame, then, the supporting assembly frame is provided with the serpentine springs to form the main structure of the supporting assembly, and the supporting assembly is directly combined to the iron sofa frame, so that a structure in which an additional seat-wrapped frame is introduced to support the soft package is rejected, an existing iron sofa frame structure and a production process of the iron sofa frame are simplified, the assembling and production efficiencies are increased, materials are saved, the cost is reduced, and thus, the production method is suitable for industrial assembly line mass production.

Figure 1:
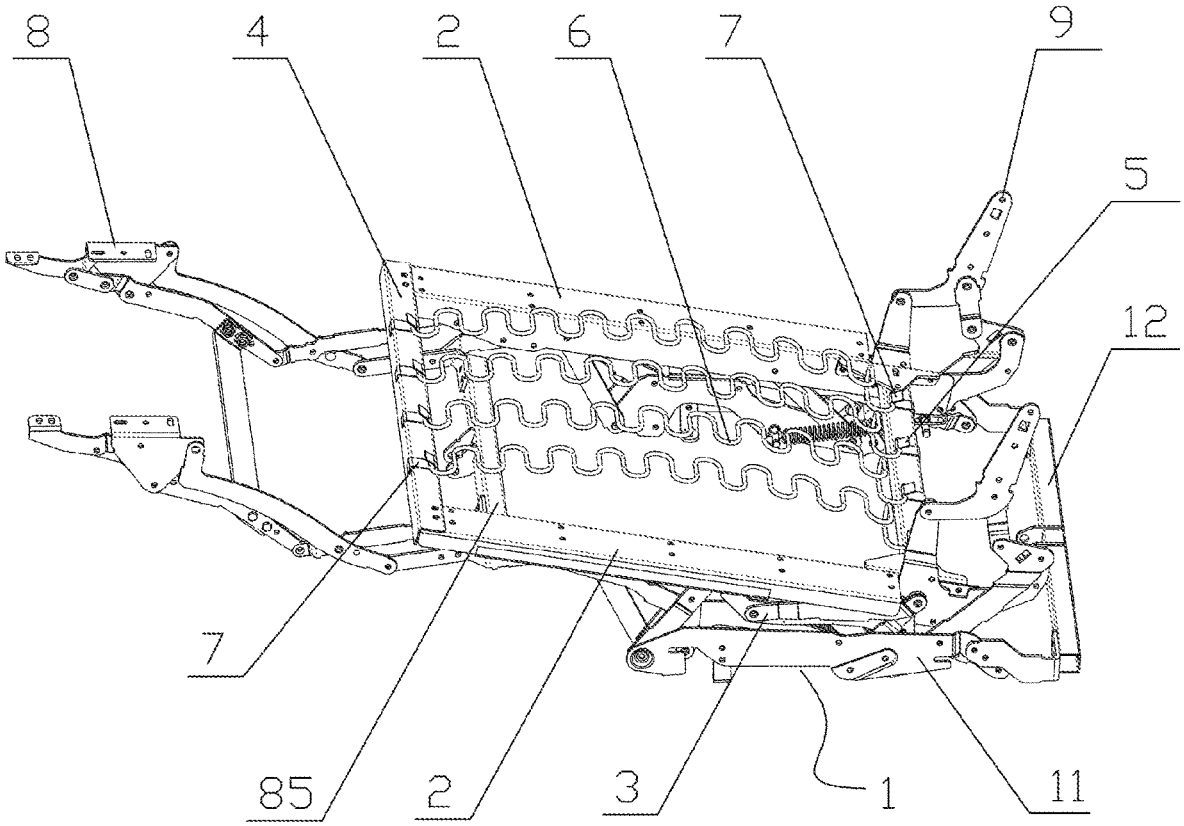
FIG. 1 is a schematic diagram showing a structure in embodiment 1 of the present invention.

Meanings of symbols in the accompanying drawings are described as follows:

1, base; 11, fixed mounting plate; 12, rear motor driving rod; 2, supporting plate; 21, inner side plate; 211, fixed vertical plate; 212, connection port; 22, outer side plate; 23, panel; 231, mounting hole; 24, snap hole; 25, L-shaped load bearing piece; 251, vertical seat; 252, bearing plate; 26, hinge point; 27, intermediate cross rod; 3, driving link set; 31, intermediate mounting plate; 32, first link set; 321, first link; 322, second link; 33, second link set; 331, third link; 332, fourth link; 333, fifth link; 334, sixth link; 335, seventh link; 336, eighth link; 34, driven link; 35, ninth link; 36, tenth link; 4, front rod; 41, first vertical plate; 42, first transverse plate; 43, hole; 5, rear rod; 51, second vertical plate; 52, second transverse plate; 6, serpentine spring; 7, fixing mechanism; 71, hook; 711, bulge; 72, hook end; 73, fixed end; 8, leg telescoping assembly; 81, main footrest link; 82, leg link set; 821, first telescopic link; 822, second telescopic link; 823, third telescopic link; 824, fourth telescopic link; 83, auxiliary footrest link; 84, auxiliary footrest driving link; 85, front motor driving rod; 9, backrest assembly; 91, backrest bracket; 92, backrest supporting bracket; 93, backrest link set; 931, first rotary link; 932, second rotary link; 933, third rotary link; and 94, fixed link.

DETAILED DESCRIPTION OF THE ILLUSTRATED EMBODIMENTS

For better understanding and implementation, technical solutions in embodiments of the present invention will be clearly and completely described below in conjunction with the accompanying drawings in the embodiments of the present invention.

Unless defined otherwise, all technical and scientific terms used herein have the same meaning as commonly understood by the skilled in the art belonging to the present invention. Terms used herein in the specification of the present invention are merely intended to describe specific embodiments, rather than to limit the present invention.

Embodiment 1

Throughout development processes of sofas, for sofas beginning from an original fixed wooden product to a soft wooden-frame sofa, an iron-wooden combined sofa and a functional sofa having various functions due to the arrangement of a functional iron frame at present, their functions are improved all the time, and their processes are also progressed all the time, however, it is difficult to thoroughly reject a wooden structure in the sofa and particularly a seat-wrapped frame in an iron sofa frame structure of a sofa. The reason is that the seat-wrapped frame is configured to support a soft package to increase the supporting area of the soft package, improve the comfort level and prolong the service life of the soft package. A sofa fabric on the soft package is required to be fixed with the seat-wrapped frame, and therefore, if a wooden seat-wrapped frame is adopted, it is convenient to rivet and fix the fabric and the wooden seat-wrapped frame, meanwhile, and it is also convenient to fixedly combine the wooden seat-wrapped frame with an iron sofa frame. In a production process of such sofas, more and complicated process steps are adopted, but production may be performed without specific mechanical devices and may be completed artificially, so that initial investments of enterprises are reduced; in addition, during production, furniture enterprises with lower strength may entrust other enterprises to produce the wooden seat-wrapped frame, so that investment costs of the enterprises are reduced. At present, parts of furniture enterprises with higher strength have adopted seat-wrapped frames made of iron frames, however, the concept thereof is still excessively confined, it is still necessary to produce specific seat-wrapped frames, and problems such as more production processes, assembly trouble, low production efficiency and high production material consumption may not be solved.

In order to adapt to the globalized furniture market, it is necessary to integrate the industrial chain of sofas, improve the structures and production processes of the sofas, integrate and centralize means of production of the sofas, control the quality and production cost of the sofas and try to realize the standardized and automatic production of the sofas, in this way, the furniture enterprises may play a dominating role in the global market, and products made in China may be exported to the foreign. Based on the above reason, the present invention provides an iron sofa frame structure mounted on a sofa. In the iron sofa frame structure, an existing seat-wrapped frame is removed, and a supporting assembly configured to support a soft package and be connected with a sofa fabric is combined to an original part.

As shown in FIG. 1 to FIG. 7, the iron sofa frame structure in the present embodiment includes a seat frame, two symmetrically disposed backrest assemblies 9 and two symmetrically disposed leg telescoping assemblies 8. Due to the adoption of the seat frame in the present embodiment, a structure in which an additional wooden frame is introduced to support the soft package is rejected, and the effect of supporting the soft package is fused on the seat frame in the present embodiment. Specifically, the seat frame includes a supporting assembly for supporting a soft package, the supporting assembly includes a supporting assembly frame, a plurality of serpentine springs 6 and fixing mechanisms 7 for detachably fixing the serpentine springs 6 on the supporting assembly frame, and in detail, the supporting assembly frame is formed by connecting a front rod 4, a rear rod 5 and supporting plates 2 at two ends in pairs.

In the present embodiment, the serpentine springs 6 are used as elastic bearing pieces to play a role in elastically bearing the soft package. Admittedly, in other preferred embodiments, the elastic bearing pieces may also be elastic bands or combinations of springs and the elastic bands, so that the effect of elastically bearing the soft package of the sofa is achieved.

Referring to any one of accompanying drawings in FIG. 1 to FIG. 4, in the iron sofa frame structure, there is no doubt that the seat frame further includes a known base 1 and two known oppositely disposed driving link sets 3, wherein upper ends of the two driving link sets 3 are respectively hinged to the two supporting plates 2, and lower ends of the two driving link sets 3 are respectively hinged to the base 1, so that the two supporting plates 2 are connected to the base 1; and the two supporting plates 2 are oppositely disposed, and preferably, the two supporting plates 2 are symmetrically disposed.

Referring to FIG. 1, the front rod 4 and the rear rod 5 are correspondingly disposed at intervals between the two supporting plates 2, and the plurality of serpentine springs 6 are uniformly arranged between the front rod 4 and the rear rod 5. When the two supporting plates 2 are driven by an external force to extend or retract relative to the base 1, the two supporting plates 2 drive the front rod 4 and the rear rod 5 to synchronously act, so that the supporting assembly in the seat frame extends or retracts relative to the base 1, and furthermore, the soft package extends or retracts.

Preferably, in the present embodiment, each of the two supporting plates 2, the front rod 4 and the rear rod 5 is made of a metal material. Admittedly, in another preferred embodiment, the two supporting plates 2, the front rod 4 and the rear rod 5 may be further made by injection molding of engineering plastics or combining metals with the engineering plastics.

In the prior art, the seat-wrapped frame of the iron sofa frame structure is supported by the supporting plates 2, that is, the seat-wrapped frame is fixedly connected to the two supporting plates 2 to fix the seat-wrapped frame, and then, the seat-wrapped frame is provided with the elastic bearing pieces and the soft package.

However, in the present invention, the supporting assembly for supporting the soft package is mainly composed of the two supporting plates 2, the front rod 4, the rear rod 5 and the elastic bearing pieces, and the two supporting plates 2 are respectively hinged with the driving link sets 3 so as to be connected to the base 1, and the supporting assembly is directly combined to the iron sofa frame structure, so that a structure in which an additional seat-wrapped frame is introduced to support the soft package is rejected, a production process of an iron sofa frame is simplified, the assembling and production efficiencies are increased, materials are saved, and the cost is reduced; and the front rod 4 and the rear rod 5 which are made of the metal material are high in connection strength and capable of conveniently realizing standardized and automatic production, so that the overall iron sofa frame structure may be produced in the same workshop, the logistic cost of internal production is reduced, and the production efficiency is further increased.

On one hand, the supporting plates 2 in the present embodiment play a role in supporting the soft package, and on the other hand, in order to conveniently and rapidly mount the soft package on an iron frame and lower the difficulty of disassembling the soft package from the iron frame without damaging leather or cloth (that is, the sofa fabric) of the soft package, each of the supporting plates 2 in the present embodiment includes a panel 23 for supporting the soft package and an outer side plate 22 vertically fixed on the outer side of the lower surface of the panel 23, and the outer side plate 22 is used as a mating piece to be matched with connecting pieces disposed on the soft package to realize the mounting of the soft package.

Referring to any one of accompanying drawings in FIG. 1 to FIG. 4 and FIG. 7, there is no doubt that each of the supporting plates 2 further includes an inner side plate 21 disposed at the inner side of the lower surface of the panel 23, the inner side plate 21 is provided with several hinge points 26 for hinging the driving link set 3, the backrest assemblies 9 are connected to the base 1 and the inner side plates 21, and the leg telescoping assemblies 8 are connected to the inner side plates 21.

Figure 7:
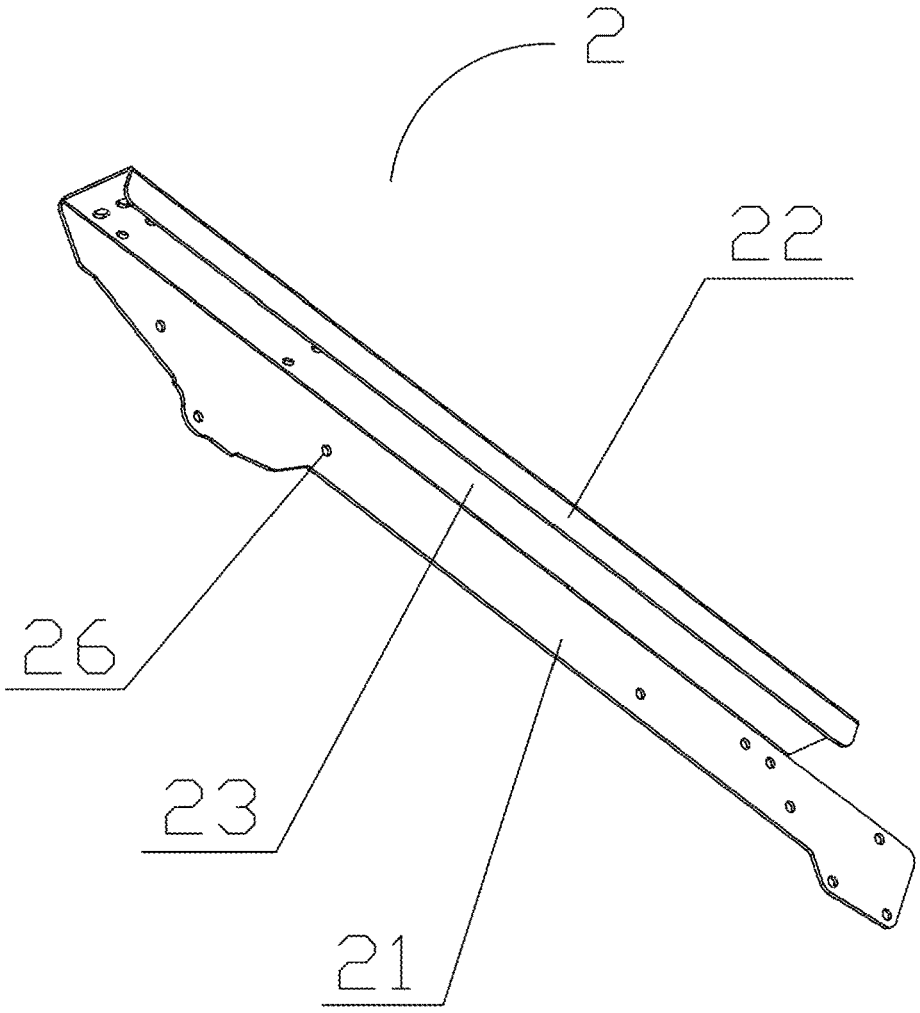
FIG. 7 is a schematic diagram showing a structure of a supporting plate shown in FIG. 1.

Referring to FIG. 7, in the present embodiment, the cross section of each of the supporting plates 2 is approximately inverted U-shaped, and the panel 23 is connected to the tops of the inner side plate 21 and the outer side plate 22. The panel 23 is shaped like an elongated plate and is horizontally disposed, the length direction of the panel 23 is vertical to the length direction of the front rod 4, meanwhile, the width of the panel 23 is greater than 5 cm, so that the panel 23 may be better supported at the side edge of the soft package to increase the supporting area of the soft package, improve the comfort level and prolong the service life of the soft package.

In the present embodiment, the inner side plate 21, the outer side plate 22 and the panel 23 are of a structure formed by integral bending. In order to facilitate processing and maintain the supporting plates 2 having higher supporting strength, the inner side plate 21, the outer side plate 22 and the panel 23 are formed by bending the same steel plate.

It should be noted that the inner side plate 21, the outer side plate 22 and the panel 23 are not limited to be formed by integral bending and may also be fixedly connected by using a welding method.

The inner side plate 21 and the outer side plate 22 are respectively located at the inner and outer sides of the lower surface of the panel 23, that is, the inner side plate 21 and the outer side plate 22 are respectively located at the inner and outer sides of the supporting assembly frame. During leather upholstering, the soft package may be assembled by working personnel by snap connection of the connecting pieces on the soft package to the outer side plate 22, the leather upholstering process is simple and convenient and easy to operate, bypassing the panel 23 is not needed, and the sofa fabric wrapping the soft package and the panel 23 are prevented from being worn.

Figure 4:
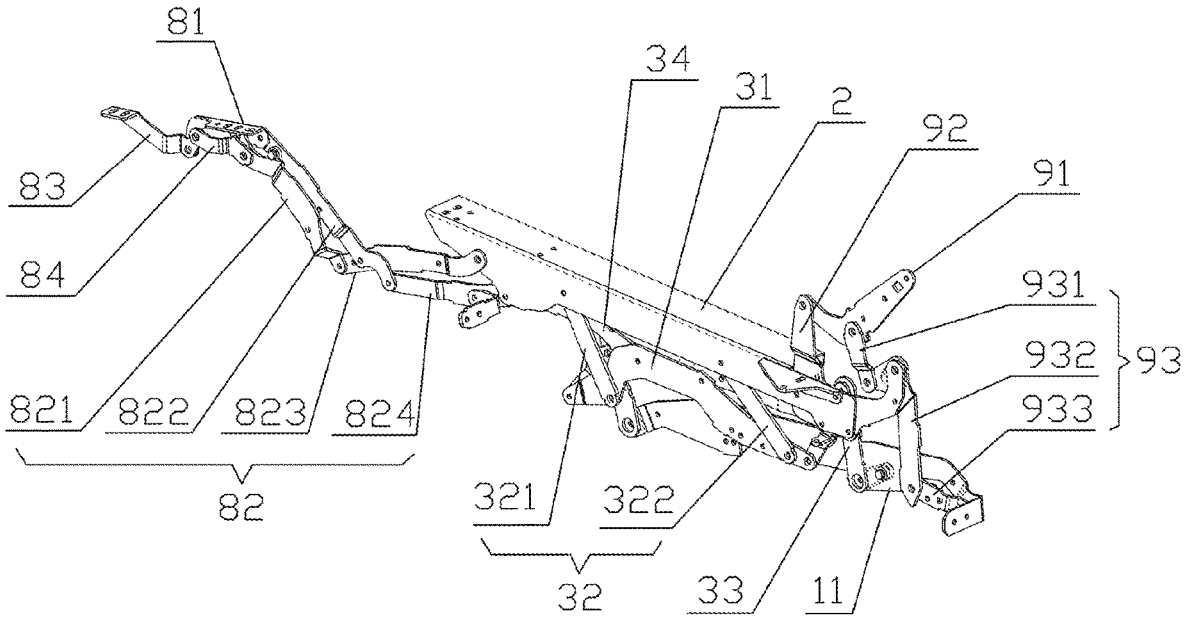
FIG. 4 is a schematic diagram showing the connection of a single-side functional rack shown in FIG. 1.
Figure 5:
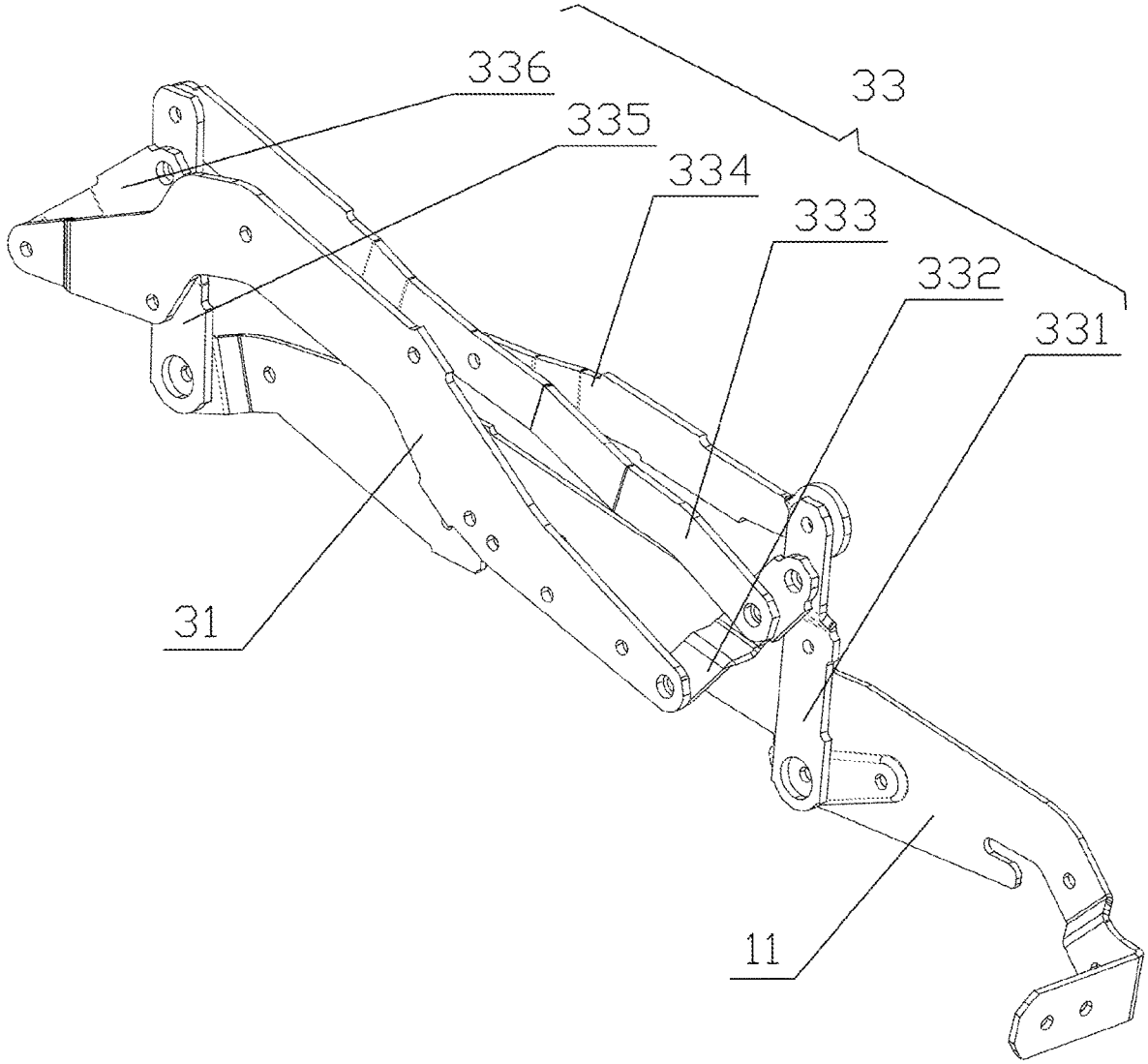
FIG. 5 is a schematic diagram showing the connection between a second link set shown in FIG. 4 and each of an intermediate mounting plate and a fixed mounting plate.

Referring to FIG. 1, FIG. 4 and FIG. 5, in the present embodiment, specific structures of the base 1, the driving link sets 3, the leg telescoping assemblies 8 and the backrest assemblies 9 are shown in the prior art. In order to facilitate understanding of the supporting plates 2, the specific structure of each of the base 1, the driving link sets 3, the leg telescoping assemblies 8 and the backrest assemblies 9 meeting a functional demand of the present invention will be described hereunder.

The base 1 includes two oppositely disposed fixed mounting plates 11 and a rear motor driving rod 12 connected with the two fixed mounting plates 11; each of the driving link sets 3 includes an intermediate mounting plate 31, a first link set 32 and a second link set 33, the first link set 32 is connected between the intermediate mounting plate 31 and each of the supporting plates 2, the second link set 33 is connected between the intermediate mounting plate 31 and each of the fixed mounting plates 11 of the base 1, and the two supporting plates 2 are driven by an external force to synchronously extend and retract relative to the base 1 by taking the base 1 as a fixed part.

Specifically, the first link set 32 includes a first link 321 and a second link 322 which are oppositely disposed, two ends of the first link 321 and the second link 322 are respectively hinged to the intermediate mounting plate 31 and the supporting plate 2, and the first link 321, the second link 322, the intermediate mounting plate 31 and the supporting plate 2 form a four-link mechanism. The second link set 33 includes a third link 331, a fourth link 332, a fifth link 333, a sixth link 334, a seventh link 335 and an eighth link 336; one end of the third link 331 is hinged to the fixed mounting plate 11, and the other end of the third link 331 is hinged to one end of the sixth link 334; one end of the fourth link 332 is hinged to one end of the intermediate mounting plate 31, the other end of the fourth link 332 is hinged between two end points of the third link 331; one end of the fifth link 333 is hinged between two end points of the fourth link 332, and the other end of the fifth link 333 is hinged to one end of the seventh link 335; the other end of the sixth link 334 is hinged between two end points of the fifth link 333; the other end of the seventh link 335 is hinged to the fixed mounting plate 11; and one end of the eighth link 336 is hinged to the other end of the intermediate mounting plate 31, and the other end of the eighth link 336 is hinged between two end points of the seventh link 335. Therefore, the fixed mounting plate 11, the intermediate mounting plate 31, the third link 331, the fourth link 332, the fifth link 333, the sixth link 334, the seventh link 335 and the eighth link 336 form an eight-link mechanism to ensure that the intermediate mounting plate 31 is flexibly removed, and the four-link mechanism composed of the first link 321, the second link 322, the intermediate mounting plate 31 and the supporting plate 2 is matched, so that the supporting plates 2 may flexibly extend and retract in a way of basically keeping translational.

Figure 3:
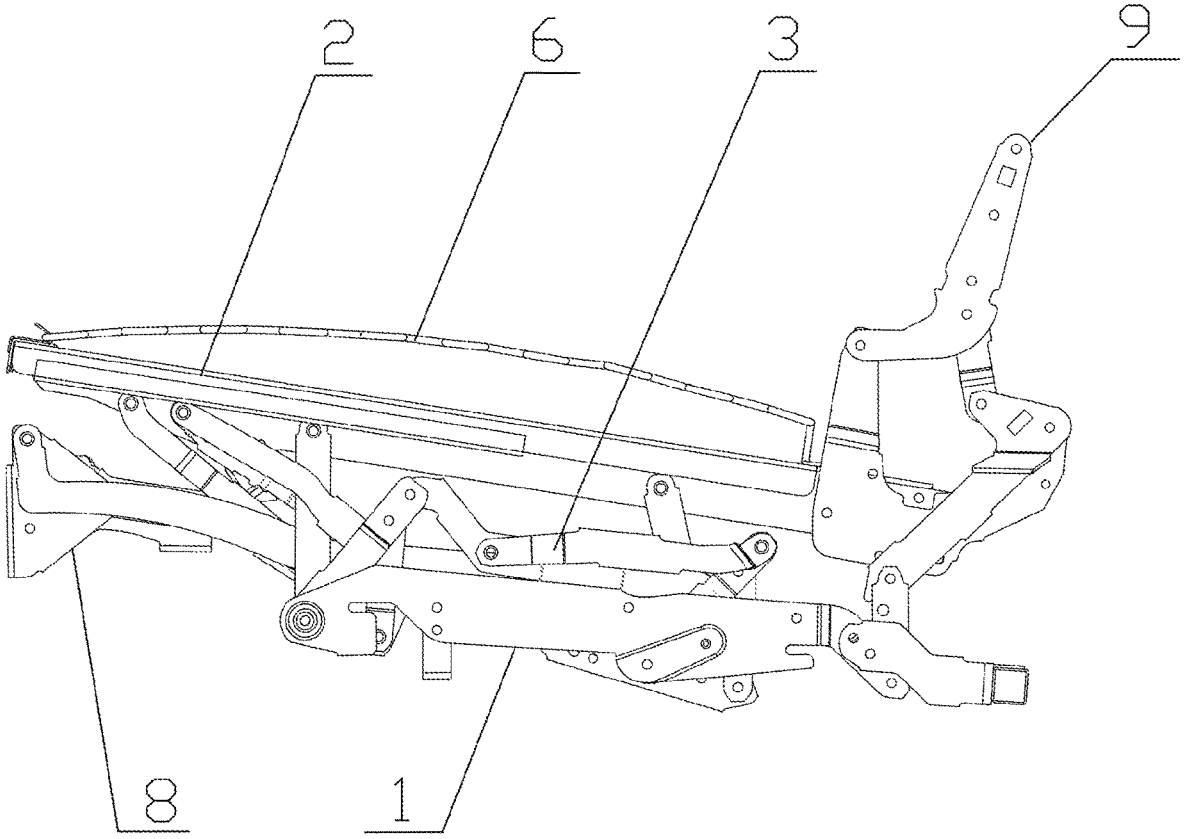
FIG. 3 is a schematic diagram showing a structure when the iron sofa frame structure shown in FIG. 1 is located on a retracted position.

Each of the leg telescoping assemblies 8 includes a main footrest link 81 and a leg link set 82, and the main footrest link 81 is hinged to the supporting plate 2 by the leg link set 82. In addition, each of the leg telescoping assemblies 8 further includes an auxiliary footrest link 83 and an auxiliary footrest driving link 84, wherein the auxiliary footrest link 83 is connected to the main footrest link 81, and the auxiliary footrest driving link 84 is connected between the leg link set 82 and the auxiliary footrest link 83. As shown in FIG. 3, when the iron sofa frame structure is in a retracted position, the auxiliary footrest link 83 is approximately parallel to the ground, and the main footrest link 81 is approximately vertical to the ground.

Specifically, the leg link set 82 includes a first telescoping link 821, a second telescoping link 822, a third telescoping link 823 and a fourth telescoping link 824. One end of the first telescoping link 821 is hinged to the main footrest link 81, and the other end of the first telescoping link 821 is hinged to one end of the third telescoping link 823; the other end of the third telescoping link 823 is hinged to the supporting plate 2; one end of the second telescoping link 822 is hinged to the main footrest link 81, and the other end of the second telescoping link 822 is hinged to one end of the fourth telescoping link 824; the other end of the fourth telescoping link 824 is hinged to the supporting plate 2; and the second telescoping link 822 and the third telescoping link 823 are further hinged between two end points of the second telescoping link 822 and the third telescoping link 823. One end of the auxiliary footrest driving link 84 is hinged between two end points of the first telescoping link 821, the other end of the auxiliary footrest driving link 84 is hinged to the auxiliary footrest link 83, and the auxiliary footrest link 83 is further hinged with the main footrest link 81. Therefore, the main footrest link 81 may rotatably extend and retract relative to the supporting plate 2.

Figure 2:
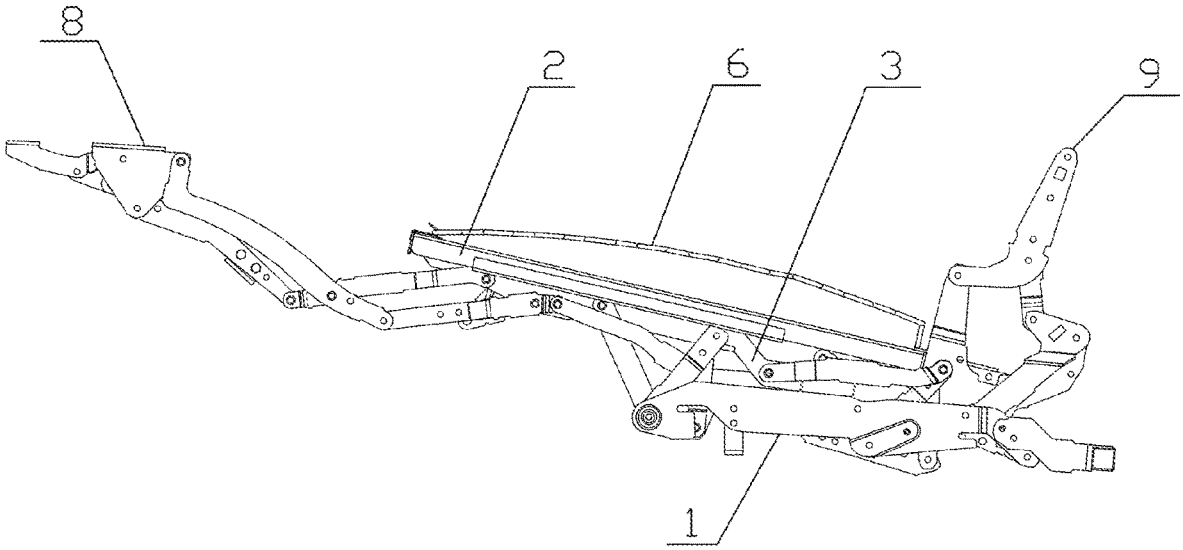
FIG. 2 is a schematic diagram showing a structure when an iron sofa frame structure shown in FIG. 1 is located on an extended position.

Each of the backrest assemblies 9 includes a backrest bracket 91, a backrest supporting bracket 92 and a backrest link set 93, and the backrest bracket 91 is connected to the supporting plate 2 and the base 1 by the backrest supporting bracket 92 and the backrest link set 93. As shown in FIG. 2, when the iron sofa frame structure is located on an extended position, the backrest bracket 91 is inclined backwards (that is, tilted backwards).

Specifically, the backrest link set 93 includes a first rotary link 931, a second rotary link 932 and a third rotary link 933; the backrest supporting bracket 92 is approximately U-shaped, the backrest supporting bracket 92 is fixedly connected to the supporting plate 2 at the U-shaped bottom of the backrest supporting bracket 92, is hinged to the backrest bracket 91 at one end of one U-shaped supporting leg and is hinged to the second rotary link 932 at one end of the other U-shaped supporting leg; one end of the first rotary link 931 is hinged to the backrest bracket 91, and the other end of the first rotary link 931 is hinged to one end of the second rotary link 932; and the other end of the second rotary link 932 is hinged to one end of the third rotary link 933, and the other end of the third rotary link 933 is hinged to the fixed mounting plate 11. Therefore, when the supporting plate 2 moves forwards, the backrest supporting bracket 92 and the third rotary link 933 are cooperated to drive the second rotary link 932 to rotate, and furthermore, the first rotary link 931 drives the backrest bracket 91 to be inclined backwards (that is, tilted backwards).

Referring to FIG. 1 and FIG. 4, a known front motor driving rod 85 (mounted between the two first telescoping links 821) may be further connected between two iron sofa frame structures, a driven link 34 may be further connected between the fourth telescoping link 824) and the intermediate mounting plate 31, electric push rods are disposed between the front motor driving rod 85 and the rear motor driving rod 12 to drive the front motor driving rod 85 and the rear motor driving rod 12 to relatively move, so that the leg telescoping assemblies 8 are unfolded from a folded state to an extension state, and the driven link 34 drives the supporting plate 2 to be unfolded from a retraction state to an extension state relative to the base 1, and the supporting plate 2 drives the backrest supporting bracket 92 to move forwards, so that the backrest bracket 91 is inclined backwards, and furthermore, the overall iron sofa frame structure extends forwards to be convenient for a user to obliquely lie for rest.

Preferably, in order to ensure that connecting pieces of the soft package may complete a detaching action together with the mating pieces, snap bars are required to be sewn as the connecting pieces on a corresponding position of leather or cloth (that is, the sofa fabric) of the soft package when the iron sofa frame structure in the present embodiment is adopted. During mounting, the lower edge of the outer side plate 22 is snapped by using the snap bars, and thus, a connection between the iron frame and the soft package is realized.

Figure 6:
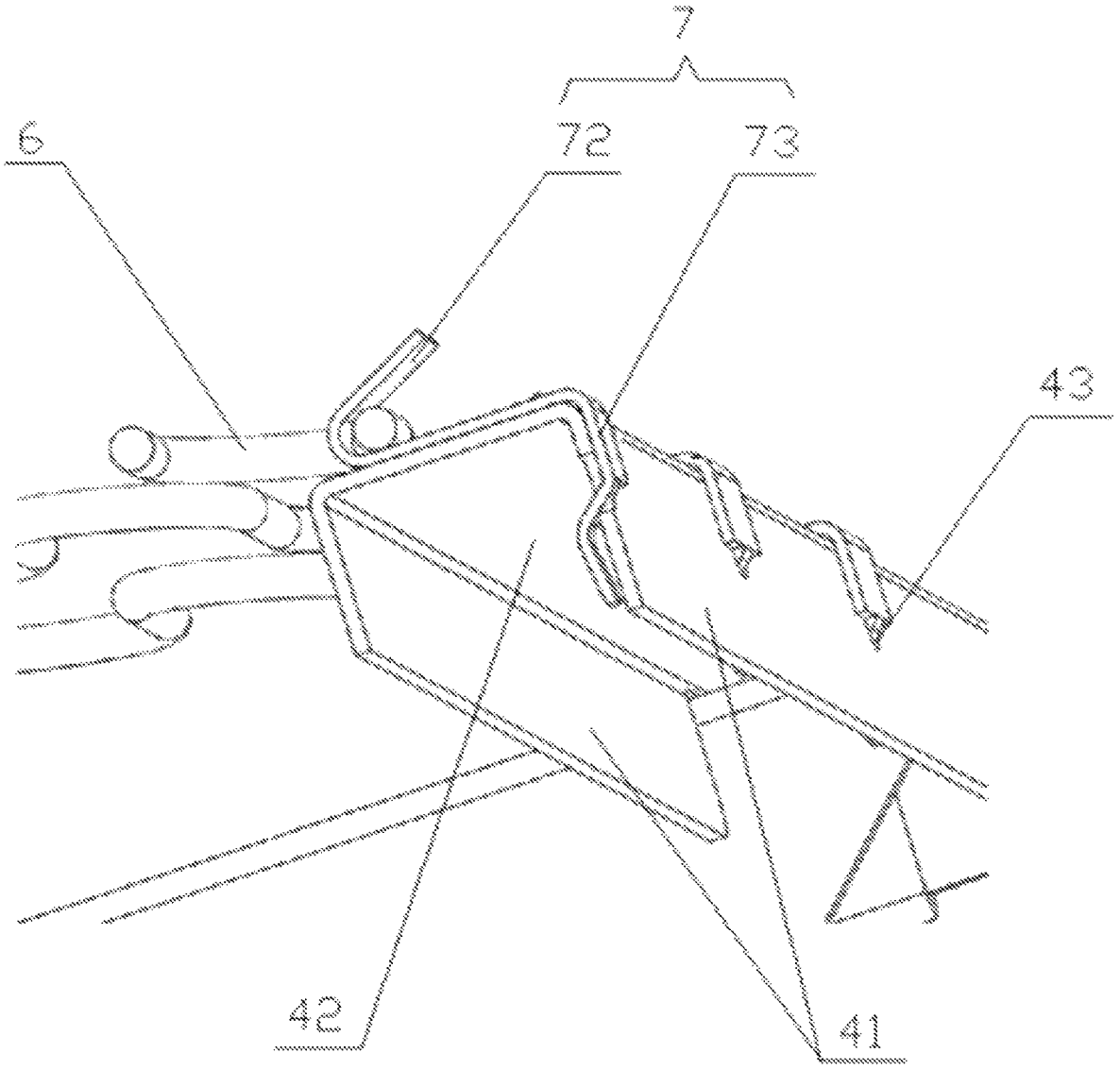
FIG. 6 is a schematic diagram showing the connection between a front rod and a fixing mechanism shown in FIG. 1.

Each part in the present embodiment is described in detail. As shown in FIG. 6, a connection relationship between each of the fixing mechanisms 7 and the front rod 4 is specifically shown with the front rod 4 as an example. Each of the fixing mechanisms 7 in the present embodiment is formed by vertically connecting a fixed end 73 and a hook end 72, the outer side wall of each of the front rod 4 and the rear rod 5 is provided with several holes 43 for inserting and fixing the fixed ends 73, the fixed ends 73 of the fixing mechanisms 7 are inserted into the holes 43 of the front rod 4 or the rear rod 5 so as to be fixed, and the hook ends 72 are disposed on the upper surface of the front rod 4 or the rear rod 5 and are connected with the serpentine springs 6. As shown in FIG. 1, the plurality of serpentine springs 6 in the present embodiment form a spring surface which is an upwards protruding arc-shaped surface, and due to the adoption of the spring surface with such a structure, the user comfort level of the user is improved.

Preferably, as shown in FIG. 6, each of the fixed ends 73 is of a Z-shaped structure, the ends with the Z-shaped structures are snapped into the holes 43, and the other ends of the Z-shaped structures are connected with the hook ends 72. During use, the fixing mechanisms 7 may be fixed on the front rod or the rear rod 5 by the pulling edges of the serpentine springs 6 via the Z-shaped structures, and the fixing mechanisms 7 may be fixed without screw fixing, so that the cost is reduced, and the assembling efficiency of the fixing mechanisms 7 is increased.

As shown in FIG. 1 and FIG. 2, in order to match with the supporting plates 2 and meet a requirement for the structural strength of the seat frame, each of the front rod 4 and the rear rod 5 in the present embodiment is of an inverted L-shaped angle iron structure, two ends of each of the supporting plates 2 are correspondingly embedded into the front rod 4 and the rear rod 5 and are fixed by using embedded screws. Of course, the supporting plates 2, the front rod 4 and the rear rod 5 in the present embodiment may also be connected by welding or adopting bolts with vertical structures.

Specifically, the front rod 4 includes a first transverse plate 42 and first vertical plates 41 disposed at the outer side of the lower surface of the first transverse plate 42, and the rear rod 5 includes a second transverse plate 52 and second vertical plates 51 disposed at the outer side of the lower surface of the second transverse plate 52, wherein the holes 43 are located in the first vertical plates 41 and the second vertical plates 51. Preferably, the first vertical plates 41 and the first transverse plate 42 are formed by integral bending, and the second vertical plates 51 and the second transverse plate 52 are formed by integral bending.

Admittedly, as shown in FIG. 6, there is no doubt that each of the front rod 4 and the rear rod 5 may further adopt an inverted U-shaped channel iron structure, wherein the front rod 4 includes two oppositely disposed first vertical plates 41 and a first transverse plate 42 connected with the two first vertical plates 41, and the two first vertical plates 41 are respectively located at the inner and outer sides of the lower surface of the first transverse plate 42; and the rear rod 5 includes two oppositely disposed second vertical plates 51 and a second transverse plate 52 connected with the two second vertical plates 51, and the two second vertical plates 51 are respectively located at the inner and outer sides of the lower surface of the second transverse plate 52. The holes 43 are located in the first vertical plate 41 at the outer side of the front rod 4 and the second vertical plate 51 at the outer side of the rear rod. Preferably, the two first vertical plates 41 and the first transverse plate 42 are formed by integral bending, and the two second vertical plates 51 and the second transverse plate 52 are formed by integral bending.

When the soft package is required to be fixed by using the front rod 4 and the rear rod 5, the connecting pieces on the sofa fabric may be snapped on the lower edges of the first vertical plates 41 and the second vertical plates 51 so that the front rod 4 and the rear rod 5 are connected with the soft package. Due to the combination of a connection effect of the two supporting plates 2 and the soft package, the soft package and the supporting assembly frame are connected more firmly, and the sofa fabric wrapping the soft package may be subjected to leather upholstering more closely and beautifully.

Embodiment 2

Figure 8:
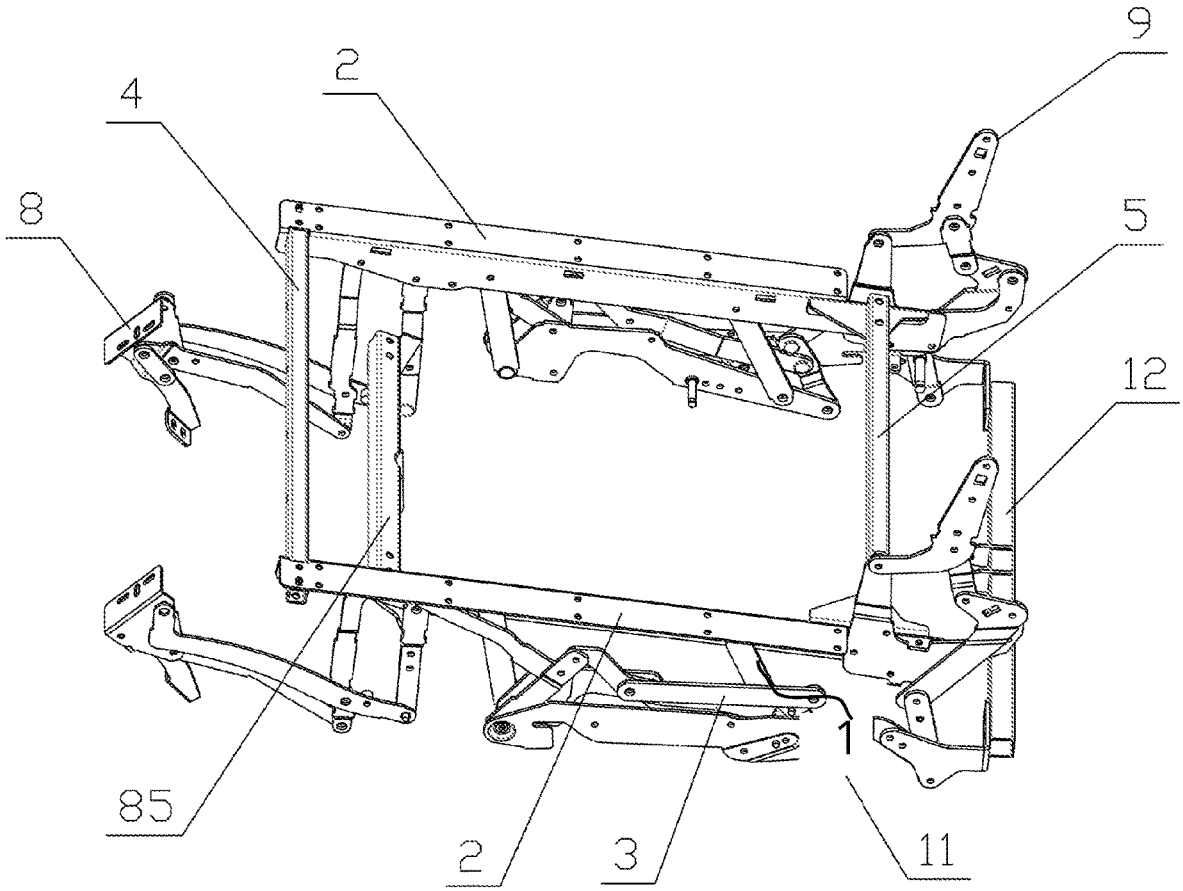
FIG. 8 is a schematic diagram showing a structure in embodiment 2 of the present invention.

Referring to FIG. 8, an iron sofa frame structure in the present embodiment is different from the structure in embodiment 1 in that the adopted supporting plates 2 have different structures and are specifically described as follows:

each of the supporting plates 2 in the present embodiment includes a panel 23 for supporting a soft package and an inner side plate 21 vertically fixed at the inner side of the lower surface of the panel 23, the inner side plate 21 is provided with a plurality of snap holes 24, and the inner side plate 21 and the snap holes 24 form the mating piece in the present embodiment, and during actual production, the snap holes 24 adopt square holes, and the plurality of square holes are equidistantly distributed in the inner side plate 21.

Specifically, the inner side plate 21 and the panel 23 are approximately inverted L-shaped, and the inner side plate 21 is located at the inner side of the lower surface of the panel 23. Similar to embodiment 1, the panel 23 is shaped like an elongated plate and is horizontally disposed, the length direction of the panel 23 is vertical to the length direction of the front rod 4, meanwhile, the width of the panel 23 is greater than 5 cm, so that the panel 23 may be better supported at the side edge of the soft package to increase the supporting area of the soft package, improve the comfort level and prolong the service life of the soft package.

In the present embodiment, the inner side plate 21 and the panel 23 are of a structure formed by integral bending. In order to facilitate processing and keep the higher supporting strength of the supporting plates 2, the inner side plate 21 and the panel 23 are formed by bending the same steel plate.

It should be noted that the inner side plate 21 and the panel 23 are not limited to be formed by integral bending and the inner side plate 21, the outer side plate 22 and the panel 23 may also be fixedly connected by using a welding method.

In order to ensure that connecting pieces of the soft package may complete a detaching action together with the matching pieces, snaps are required to be sewn as the connecting pieces on a corresponding position of leather or cloth (that is, the sofa fabric) of the soft package when the iron frame structure in the present embodiment is adopted. During mounting, the snaps go around under the supporting plates 2 and are inserted into the snap holes 24 in the supporting plates 2 to realize snapping, and thus, a connection between the iron frame and the soft package is completed.

In the present embodiment, the inner side plate 21 may also be hinged with the driving link set 3, a specific connection relationship between the inner side plate 21 and the driving link set 3 is described as embodiment 1, in this way, the inner side plate 21 is adopted to be connected with the driving link set 3 and the snaps on the sofa fabric, so that materials of the supporting plates are saved, and the cost and the weight are reduced.

In order to match with the supporting plates 2 and meet a requirement for the structural strength of the seat frame, each of the front rod 4 and the rear rod 5 in the present embodiment is of a square tube structure and are provided with openings in two ends, two ends of the inner side plate 21 are inserted into the corresponding openings and are fixed by using embedded screws. Of course, the supporting plates 2, the front rod 4 and the rear rod 5 in the present embodiment may also be connected by welding or adopting bolts with vertical structures.

Embodiment 3

Figure 9:
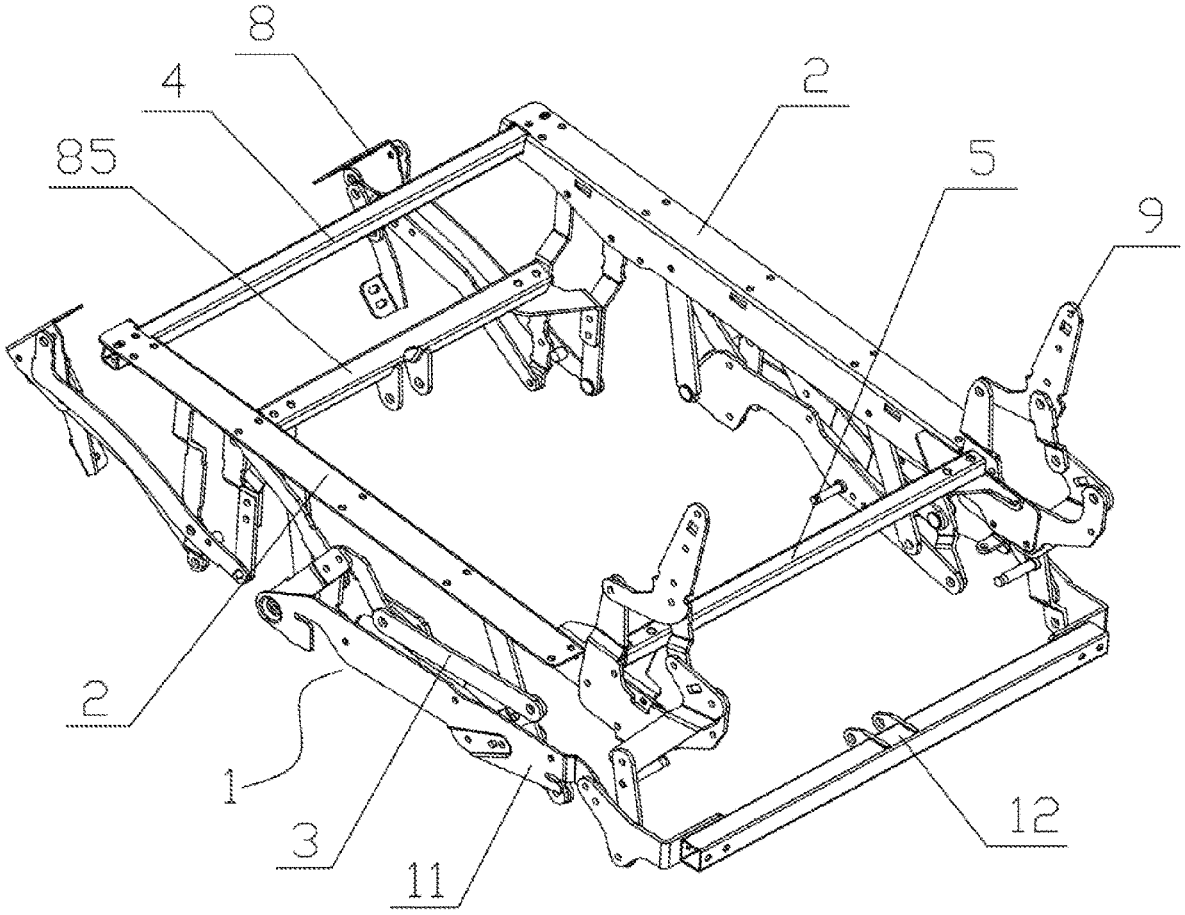
FIG. 9 is a schematic diagram showing a structure in embodiment 3 of the present invention.
Figure 11:
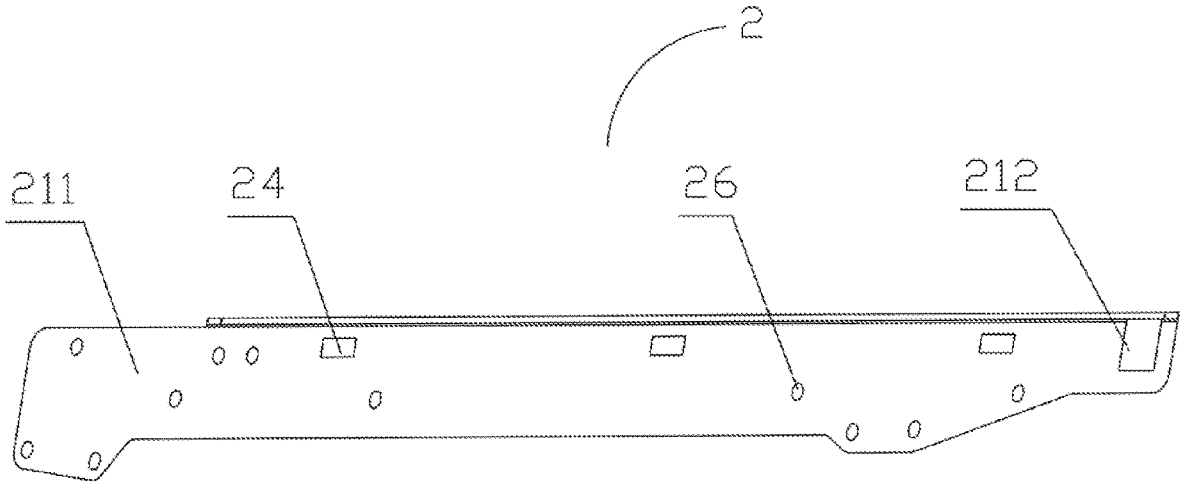

Referring to FIG. 9 and FIG. 11, an iron sofa frame structure in the present embodiment is different from the structure in embodiment 1 in that the adopted supporting plates 2 have different structures and are specifically described as follows:

each of the supporting plates 2 (the supporting plates are multidirectional fixed connecting pieces in priority document 2) provided in the present embodiment includes:

an inner side plate 21 (the inner side plate 21 is a main body supporting part in priority document 2) and a panel 23 (the panel 23 is a bearing and connecting part in priority document 2) which outwards extends from the inner side plate 21 and is outwards turned, wherein the inner side plate 21 includes a fixed vertical plate 211 which is vertically disposed, and the fixed vertical plate 211 is provided with a connection port 212 for connecting the front rod 4 (the front rod 4 is a front transverse bracing rod in priority document 2).

Based on the above, the present embodiment is applied to a sofa and is particularly applied to a foldable sofa (that is, a functional sofa), a soft package part is fixedly connected with a mechanism (a folding part) located below the soft package part by connecting pieces. However, in order to ensure the stability of the connecting pieces, the soft package part and an intermediate connection position of the folding part are not in stacked connection like a hamburger, but are connected in multiple directions, so that the connection stability is improved. For example, the side of a keel inside the soft package part is connected with the connecting pieces; and fixed positions of the folding part and the connecting pieces are located above the end surface. In the prior art, a lateral first connecting piece is connected with the soft package part, then, a forward second connecting piece is connected with the folding part, furthermore, the first connecting piece is connected with the second connecting piece, and thus, the soft package part is fixedly connected with the folding part.

In the present embodiment, due to the arrangement of the panel 23 and the fixed vertical plate 211 in the supporting plate 2 with different extension directions, the soft package part and the folding part may be simultaneously and fixedly connected.

Figure 10:
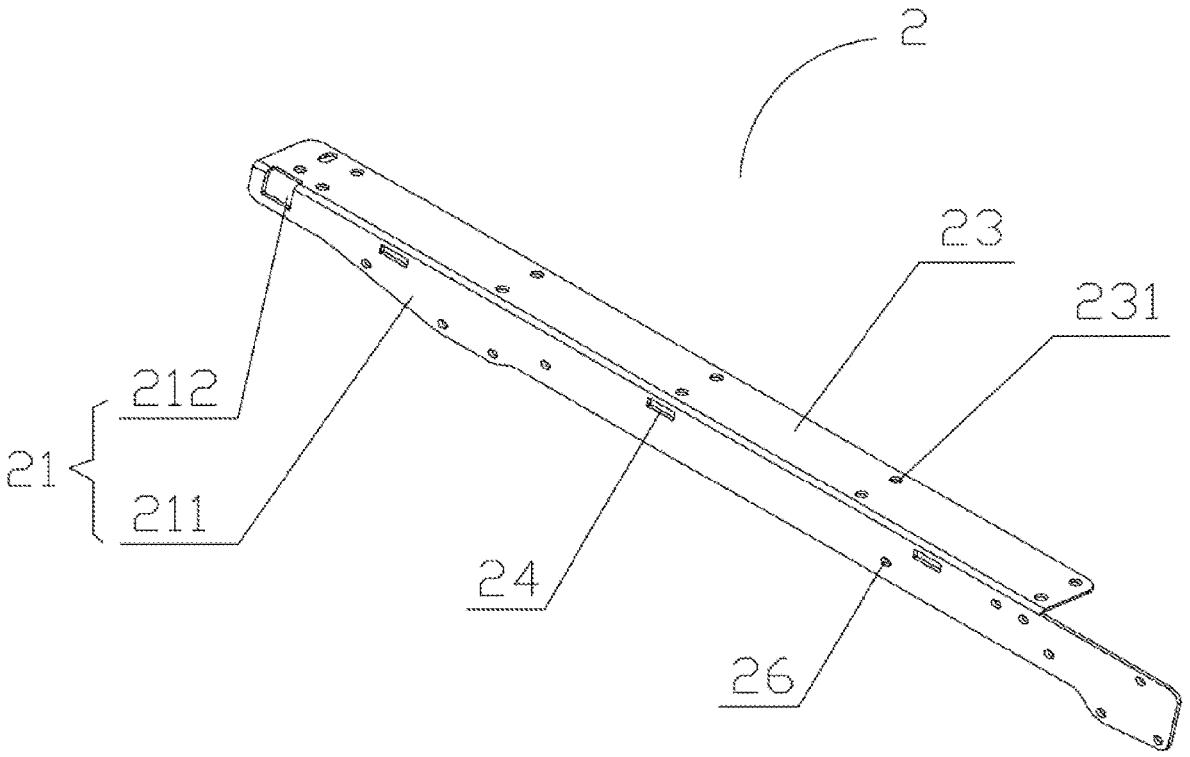
FIG. 10 and FIG. 11 are schematic diagrams showing a structure of a supporting plate shown in FIG. 9.

Specifically, referring to FIG. 10, there is no doubt that the inner side plate 21 and the panel 23 are approximately inverted L-shaped, and the inner side plate 21 is located at the inner side of the lower surface of the panel 23. Similar to embodiment 1, the panel 23 is shaped like an elongated plate and is horizontally disposed, the length direction of the panel 23 is vertical to the length direction of the front rod 4, meanwhile, the width of the panel 23 is greater than 5 cm, so that the panel 23 may be better supported at the side edge of the soft package to increase the supporting area of the soft package, improve the comfort level and prolong the service life of the soft package.

Referring to FIG. 10 and FIG. 11, there is no doubt that the fixed vertical plate 211 of the inner side plate 21 is provided with several hinge points 26 for hinging the folding part located below the sofa, so that a connection between each of the supporting plates 2 and the folding part is realized.

Based on the above, the connection port 212 is used for mortise and tenon connection between the front rod 4 and the fixed vertical plate 211. Further, the front rod 4 may be penetrated into the connection port 212 of the fixed vertical plate 211 and may be further fixed by using bolts so as to achieve the aim of fixed connection after mortise and tenon connection. The connection port 212 may be a notch adapted to the front rod 4, and a corresponding part of the front rod 4 may penetrate into the notch and may be in snap connection or fixed by using bolts at the notch.

Based on the above, the folding part is disposed below the sofa. In order to guarantee the upper and lower connection stability, the length of the side, connected with the connecting pieces, of the folding part is adapted to or equal to the lengths of the connecting pieces, and thus, the folding part may be fixed by one or more connecting pieces.

Based on the above, the panel 23 is a part outwards extending from the inner side plate 21 and is outwards turned and configured to bear and connect the soft package part. Due to the design that the panel 23 is outwards turned, the extension direction of an outwards turned end surface of the panel 23 is different from an extension direction of the fixed vertical plate 211, and the panel 23 and the fixed vertical plate 211 may be vertically disposed. Due to the utilization of the outwards turned panel 23 on the basis that the area for supporting the soft package part located above is guaranteed, raw materials are greatly saved, and the production cost is reduced.

Referring to FIG. 10, the panel 23 is provided with mounting holes 231 configured to be connected with the inside of the sofa.

Based on above, the panel 23 is provided with the mounting holes 231 which is used for connection with the soft package part and may realize fixed snap connection or hooked connection by hooks or other mechanisms, and therefore, snap mounting of external wrapping leather is convenient to realize during mounting. For example, an end surface of the panel 23 may be provided with rectangular snap holes for snap connection with a leather part of the soft package part and is provided with the round mounting holes 231 for connection with an elastic part such as sponge inside the soft package part, and thus, locking may be realized by pulling ropes or hooks and the like. The mounting efficiency is increased, procedures are reduced, and the problem that if an existing sofa such as a sofa of which the external wrapping leather is anchored on an iron frame is disassembled, the leather will be certainly damaged is avoided.

Based on the above, in the existing sofa, in order to support the soft package part located above, such as a sponge cushion, there are higher demands on the bearing capability of the connecting pieces located below, square steel is generally adopted, for guaranteeing the bearing effect, relatively large square steel needs to be adopted as a frame connecting piece, and thus, the raw materials are high in amount and high in cost. In the present embodiment, the front rod 4 is alternately in mortise and tenon connection with each of the supporting plates 2 by the connection ports 212 and may be further fixed in combination with bolts, so that the process is simple, the production efficiency is increased, the error-tolerant rate is high, and the raw materials are not wasted.

The present embodiment provides a supporting plate 2, a supporting frame and a sofa, wherein the supporting plate 2 is connected and fixed with soft packages, disposed in different directions, of a sofa and a mechanism located below the sofa by a fixed vertical plate 211 and a relatively outwards turned panel 23 of which the end surfaces are different in extension direction, and thus, the aim of simultaneously bearing the soft package part and connecting the mechanism located at the lower end is achieved by the one supporting plate 2. Compared with the arrangement of a square tube in the prior art, the outwards turned structure greatly saves raw materials and reduces the cost on the basis of increasing the bearing area. Moreover, the supporting plate 2 is provided with a connection port 212, and the front rod 4 may be connected with the inner side plate 21 by the connection port 212, so that the mounting method is simple and convenient, the process is simple, the production efficiency is increased, and the production and mounting costs are reduced.

It should be noted that the soft package part in priority document 2 is used as one part of the sofa cushion to achieve a function and effect of providing a seating surface and is connected to the upsides of the multidirectional fixed connecting pieces to achieve a function and effect consistent with those of a combination of the soft package and the sofa fabric in embodiment 1, and therefore, the soft package part may be regarded to be similar to the combination of the soft package and the sofa fabric in embodiment 1.

It should be noted that the mechanism (the folding part) located below the sofa in priority document 2 is used as a functional rack part of the sofa to achieve a function and effect of extending and retracting the sofa cushion, which are consistent with those of a combination of the base 1 and the driving link sets 3 in embodiment 1, and therefore, the folding part may be regarded to be similar to the combination of the base 1 and the driving link sets 3 in embodiment 1.

It should be noted that the multidirectional fixed connecting pieces in priority document 2 are used as parts for connecting the soft package part with the folding part to achieve a function and effect of connecting the soft package part and the folding part and is configured to simplify the structure and production process of the iron sofa frame to achieve a function and effect consistent with those of the supporting plates 2 in embodiment 1, and therefore, the multidirectional fixed connecting pieces may be regarded to be similar to the supporting plates 2 in embodiment 1. The main body supporting part in priority document 2 is used as one part of the multidirectional fixed connecting pieces to achieve a function and effect of connecting the folding part, which are consistent with those of the inner side plate 21 of each of the supporting plates 2 in embodiment 1, and therefore, the main body supporting part may be regarded to be similar to the inner side plate 21 in embodiment 1. The bearing and connecting part in priority document 2 is used as one part of the multidirectional fixed connecting pieces to achieve a function and effect of connecting and supporting the soft package part, which are consistent with those of the panel 23 of each of the supporting plates 2 in embodiment 1, and therefore, the bearing and connecting part may be regarded to be similar to the panel 23 in embodiment 1.

It should be noted that the front transverse bracing rod and a rear transverse bracing rod in priority document 2 are both connected between two multidirectional fixed connecting pieces, the front transverse bracing rod and the rear transverse bracing rod are connected with the two multidirectional fixed connecting pieces to form a supporting frame for supporting the soft package part to achieve a function and effect consistent with those of the front rod 4 and the rear rod 5 in embodiment 1, and therefore, the front transverse bracing rod and the rear transverse bracing rod may be regarded to be similar to the front rod 4 and the rear rod 5 in embodiment 1.

It should be noted that the supporting frame in priority document 2 is shaped like a rectangular frame and plays a role in supporting and connecting the soft package part, the supporting frame may be directly combined to the folding part of the sofa to achieve a function and effect consistent with those of the supporting assembly frame in embodiment 1, and therefore, the function and effect of each component in the supporting frame are also consistent with those of each component in the supporting assembly frame in embodiment 1, and therefore, the supporting frame may be regarded to be similar to the supporting assembly frame in embodiment 1.

Embodiment 4

Figure 12:
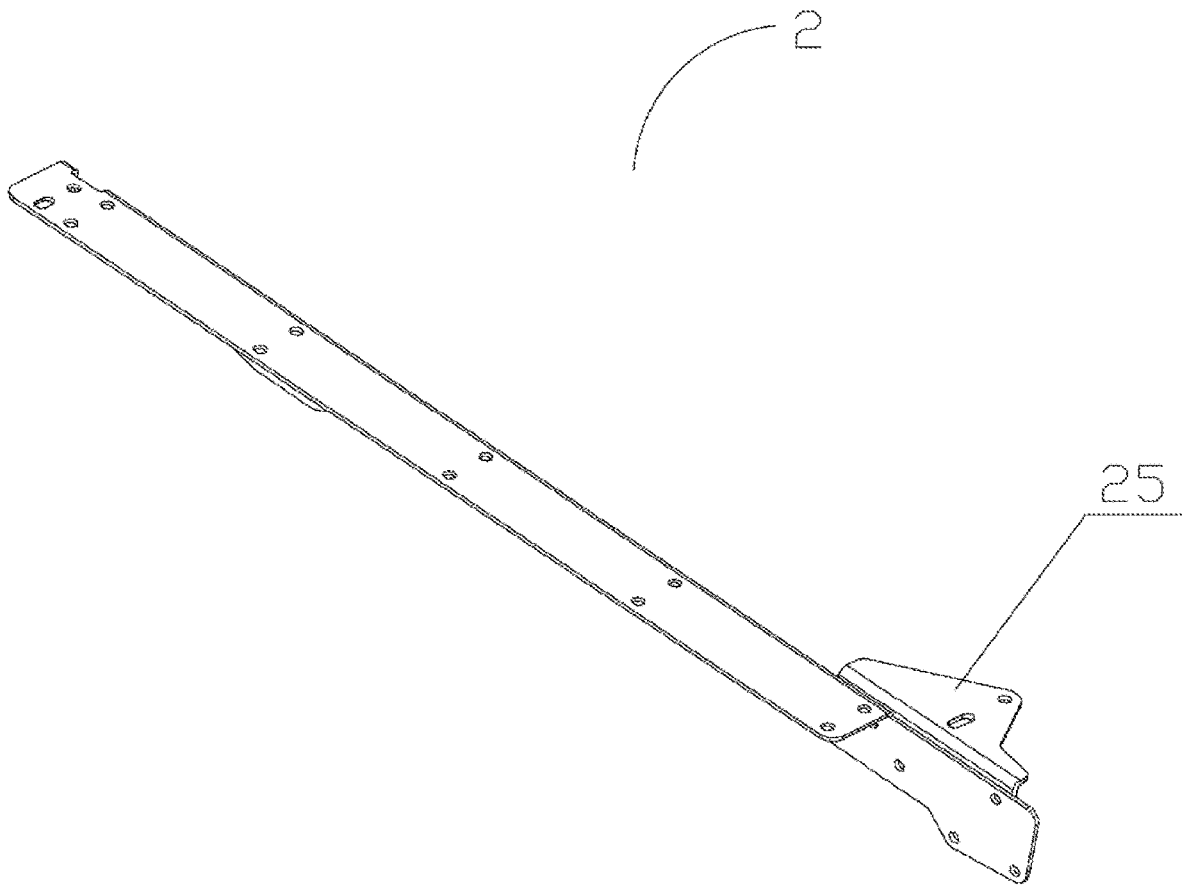
FIG. 12 is a schematic diagram showing a structure of a supporting plate in embodiment 4 of the present invention.
Figure 13:
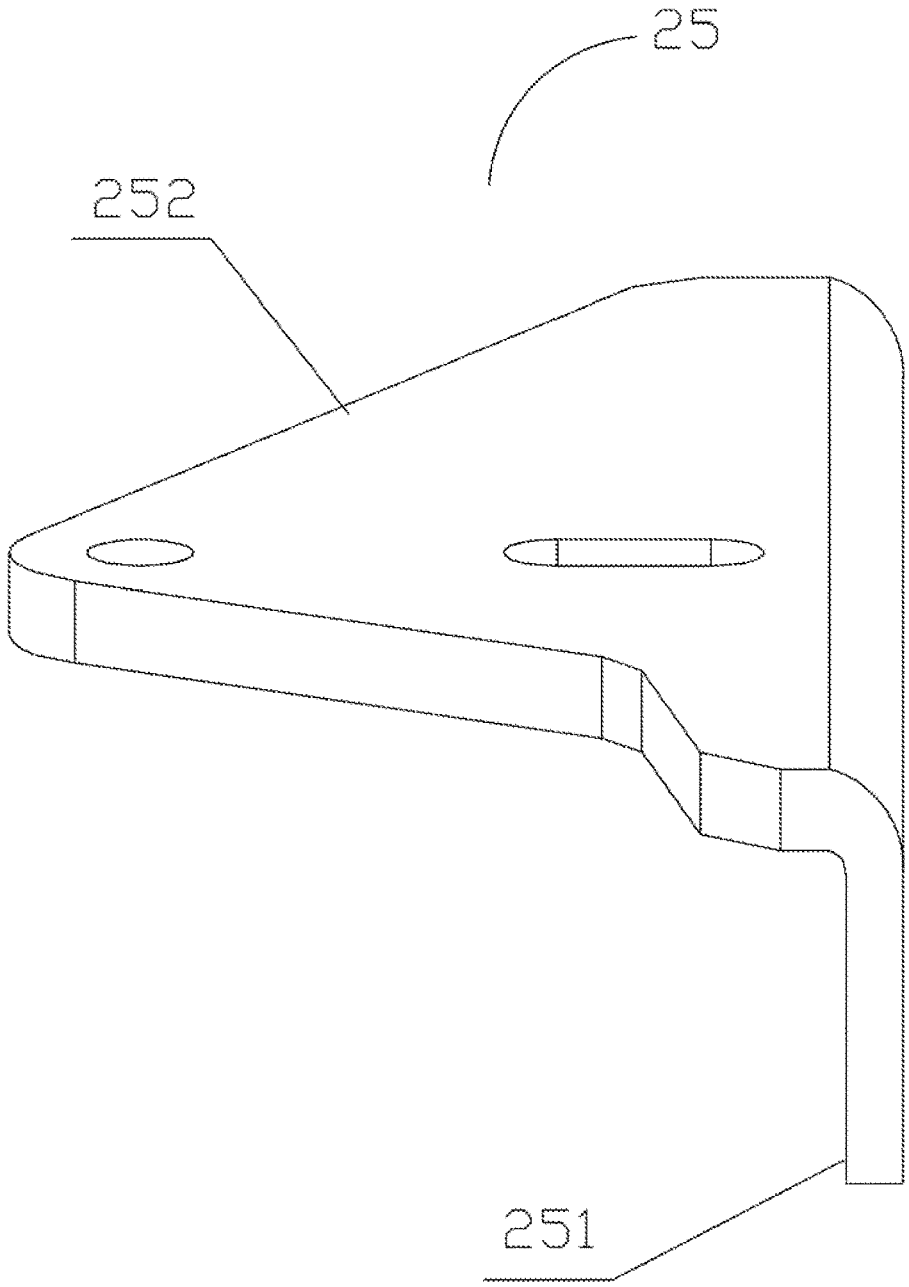
FIG. 13 is a schematic diagram showing a structure of an L-shaped load bearing piece shown in FIG. 12.

Referring to FIG. 12 and FIG. 13, an iron sofa frame structure in the present embodiment is different from the structure in embodiment 3 in that each of the supporting plates 2 further includes an L-shaped bearing piece 25 and is now specifically described as follows:

for each of the supporting plates 2 provided in the present embodiment, the fixed vertical plate 211 and the panel 23 are vertically connected in an L shape.

Further, the connection port 212 is adapted to the sectional shape of the front rod 4.

Based on the above, the section of the front rod 4 may be round or square and is adapted to the shape of the notch of the connection port 212. For example, the section of the front rod 4 is set to be square, the connection port 212 is a square notch, then, the front rod 4 may be prevented from rotating in the connection port 212 due to the fixation of four sides in the notch after penetrating into the notch, so that the stability is improved.

The L-shaped bearing piece 25 is provided with a vertical seat 251 parallel to the fixed vertical plate 211 and configured to be connected with the fixed vertical plate 211 after being fitted to the fixed vertical plate 211 and a bearing plate 252 which is outwards turned and extends based on the vertical seat 251.

The bearing plate 252 is vertical to the vertical seat 251 and is L-shaped, and the L-shaped bearing piece 25 may be connected with the rear rod 5 (the rear rod 5 is the rear transverse bracing rod in priority document 2).

Based on the above, the L-shaped bearing piece 25 is configured to bear the rear rod 5, and the rear rod 5 connected herein may be different from the front rod 4 which may penetrate into the connection port 212, so that the connection and fixation for the soft package part and the folding part are realized by a square frame formed by the front transverse bracing rod and the rear transverse bracing rod (that is, the front rod 4 and the rear rod 5) and the two supporting plates 2.

Further, the bearing plate 252 and the panel 23 are located on the same horizontal plane. Moreover, when the L-shaped bearing piece 25 is connected with the fixed vertical plate 211 by the vertical seat 251, the bearing plate 252 and the panel 23 are respectively disposed at two sides of a position where the fixed vertical plate 211 is connected with the vertical seat 251.

Based on the above, during mounting, the bearing plate 252 of the L-shaped bearing piece 25 and the panel 23 are respectively disposed at two ends of the fixed vertical plate 211 and the vertical seat 251 which are fitted after being mounted, which is equivalent to that the bearing plate 252 and the panel 23 are symmetrically disposed and disposed to be outwards turned. For example, in a sofa, two sets of bearing plates 252 are disposed to be inwards turned, the panel 23 is outwards turned, two sides of the lower end of the soft package part are respectively connected with the panel 23 which is outwards turned, and the transverse bracing rods disposed inside are respectively disposed on the two bearing plates 252 which are symmetrically disposed and are inwards turned, and thus, the distortion of the overall frame is avoided by the transverse bracing rods on the basis that the soft package part at the upper end is fixed.

It should be noted that in the soft, a force borne at the rear needs to be greater than a force borne at the front end based on lying and leaning habits. In order to improve the bearing capability and increase the stress, gravity generated when a human body lies and leans on the soft package part located above is borne by a bearing structure formed by the L-shaped bearing pieces 25 and the rear rod 5, so that the stress area is increased, and the mounting firmness and the bearing effect are improved.

Further, two ends of the length direction of the fixed vertical plate 211 are respectively an end provided with the connection port 212 and an end far from the connection port 212 and configured to be connected with the L-shaped bearing piece 25.

Based on the above, the two sets of fixed vertical plates 211 and the two transverse bracing rods form a frame, wherein two ends of the fixed vertical plates 211 in the length direction are respectively connected with the different transverse bracing rods in a way that one end is in mortise and tenon connection by virtue of the connection port 212, and the other end is connected by virtue of the L-shaped bearing piece 25.

Embodiment 5

Figure 14:
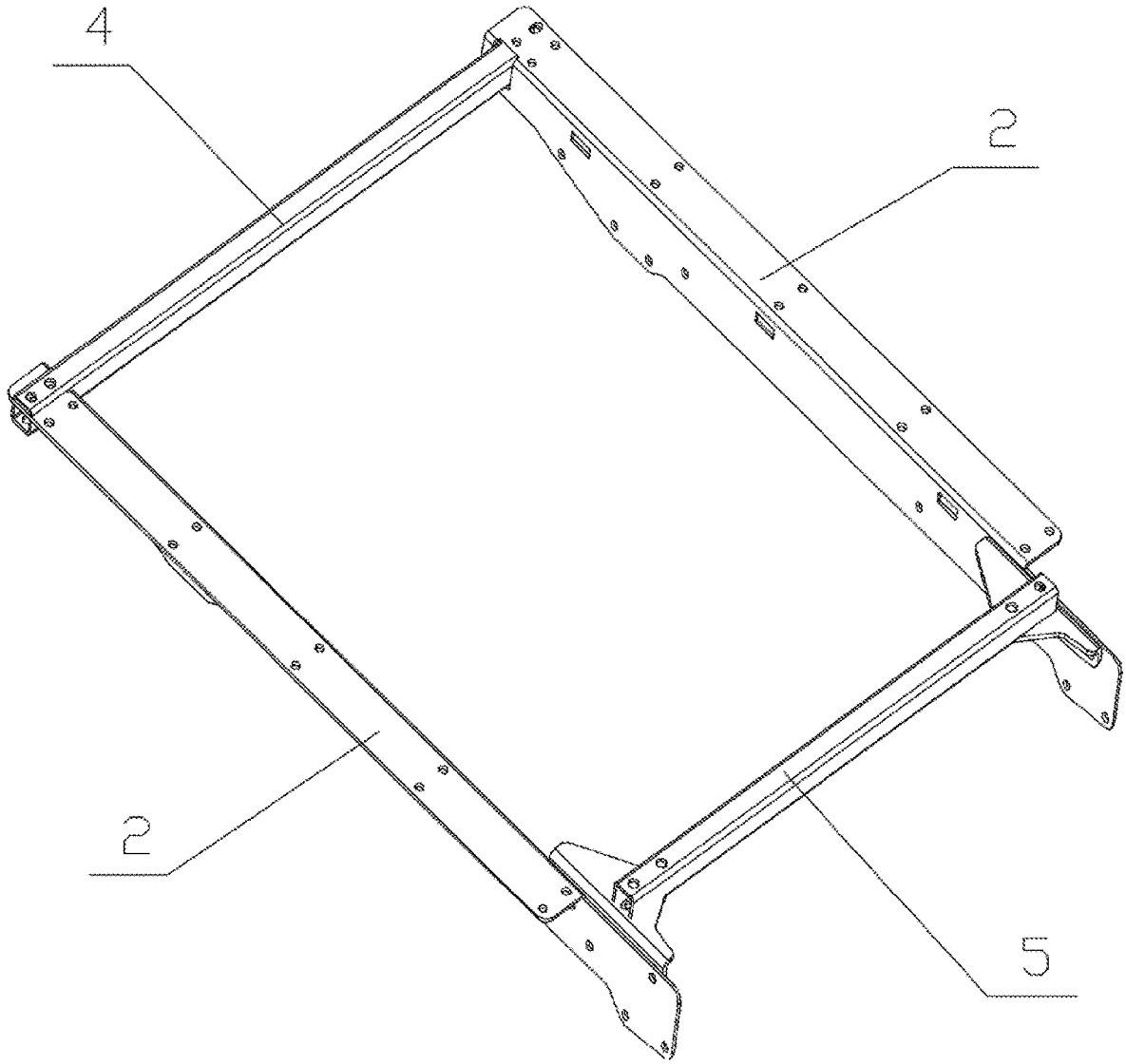
FIG. 14 is a schematic diagram showing a structure of a supporting assembly frame shown in embodiment 5 of the present invention.
Figure 15:
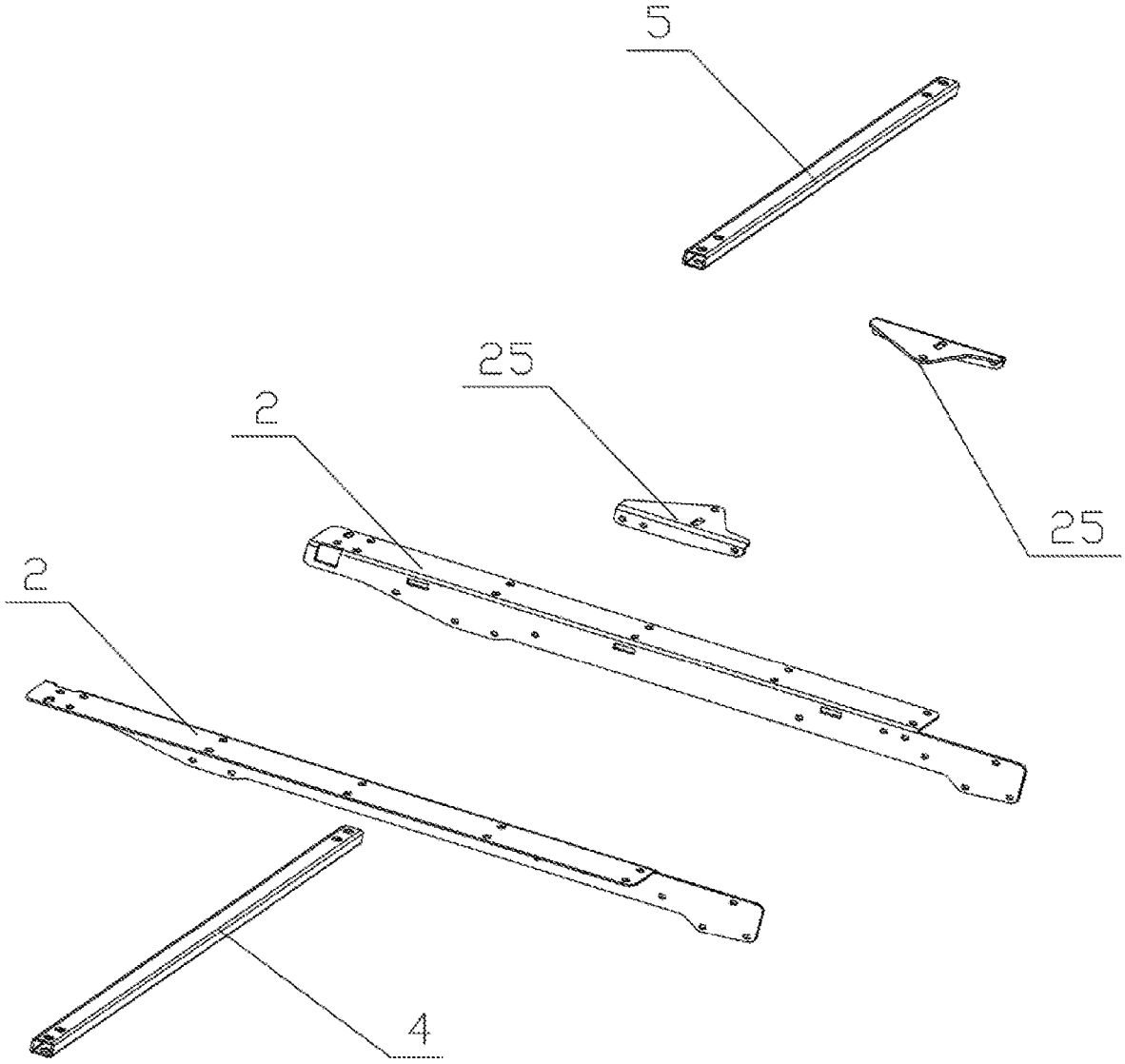
FIG. 15 is a schematic exploded view showing the supporting assembly frame shown in FIG. 14.
Figure 16:
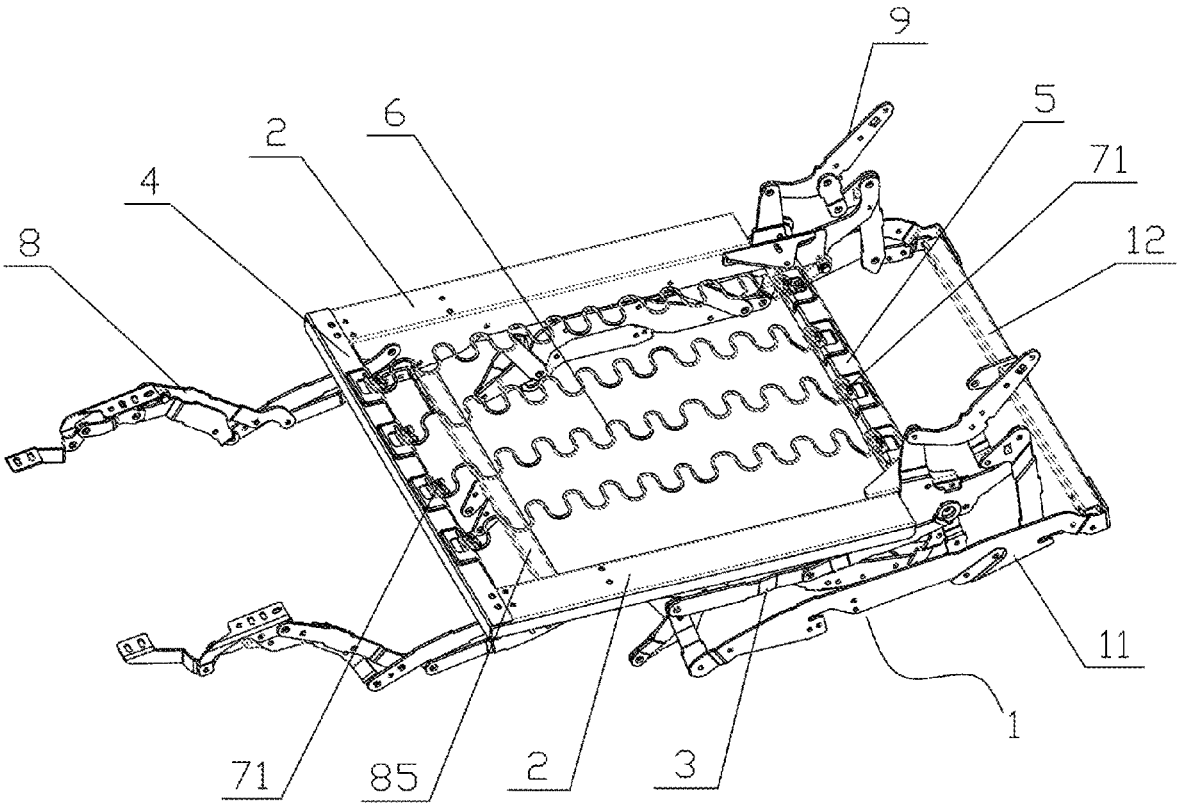
FIG. 16 is a schematic diagram showing a structure in embodiment 6 of the present invention.
Figure 17:
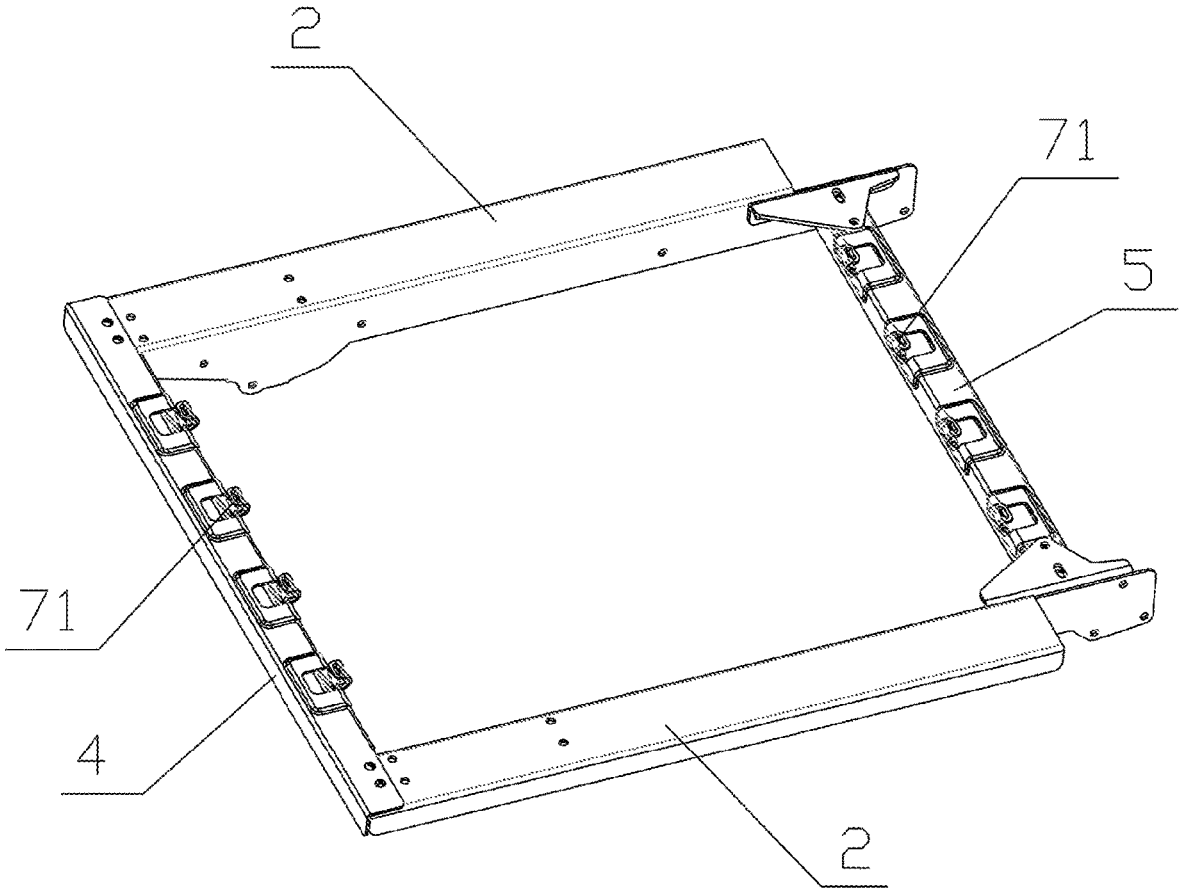
FIG. 17 is a schematic diagram showing a structure of a supporting assembly frame shown in FIG. 16.

Referring to FIG. 14 and FIG. 15, the present embodiment provides a supporting assembly frame (the supporting assembly frame is the supporting frame in priority document 2) applied to a sofa. The supporting assembly frame includes two symmetrically disposed supporting plates 2, connection ports 212 penetrating in the supporting plates 2, a front rod 4 connected with the supporting plates 2 and a rear rod 5 connected with L-shaped bearing pieces 25 of the symmetrically disposed supporting plates 2 as embodiment 4.

As the above, in the present embodiment, the supporting assembly frame is configured to connect and fix a soft package part and a folding part, wherein the supporting assembly frame may be disposed on a position between the soft package part and the folding part. The sofa may include a soft package part located above and connected by the supporting assembly frame and a folding part disposed at the lower end of the soft package part.

The supporting assembly frame includes the above-mentioned supporting plates 2 as well as the front rod 4 and the rear rod 5 which are connected with the supporting plates 2. Specifically, the supporting assembly frame may include two sets of symmetrically disposed supporting plates 2, one front rod 4 and one rear rod 5 which jointly form a square frame.

In the symmetrically disposed supporting plates 2, during mounting, bearing plates 252 of the L-shaped bearing pieces 25 and panels 23 are respectively disposed at two ends of fixed vertical plates 211 and vertical seats 251 which are fitted after being mounted, which is equivalent to that the bearing plates 252 and the panels 23 are symmetrically disposed and disposed to be outwards turned. Two sets of the bearing plates 252 are disposed to be inwards turned, the panels 23 are outwards turned, two sides of the lower end of a soft package part are respectively connected with the panels 23 which are outwards turned, and two ends of the rear rod 5 in the length direction are respectively disposed on the two bearing plates 252 which are symmetrically disposed and inwards turned, and thus, the distortion of the overall frame is avoided by transverse bracing rods on the basis that the soft package part at the upper end is fixed.

In addition, the present embodiment further provides a sofa including the supporting assembly frame described as above.

The sofa may further include a folding part and a soft package part which are both connected with the supporting assembly frame and are sequentially disposed at the lower and upper ends of the supporting assembly frame.

Embodiment 6

Referring to FIG. 16 to FIG. 21, an iron sofa frame structure in the present embodiment is different from the structure in embodiment 1 in that the adopted fixing mechanisms 7 have different structures and are specifically described as follows:

each of the front rod 4 and the rear rod 5 is provided with several hooks 71, the hooks 71 on the front rod 4 and the rear rod 5 are correspondingly disposed, the number of the hooks 71 corresponds to that of the serpentine springs 6, and two ends of the serpentine spring 6 are respectively and correspondingly connected to two of the hooks 71. In the present embodiment, the hooks 71 are used as the fixing mechanisms 7, thereby completing the detachable connection between each of the serpentine springs 6 and each of the front rod 4 and the rear rod 5.

In the present embodiment, each of the front rod 4 and the rear rod 5 adopts an inverted U-shaped channel iron structure, wherein the front rod 4 includes two oppositely disposed first vertical plates 41 and a first transverse plate 42 connected with the two first vertical plates 41, and the two first vertical plates 41 are respectively located at the inner and outer sides of the lower surface of the first transverse plate 42; and the rear rod 5 includes two oppositely disposed second vertical plates 51 and a second transverse plate 52 connected with the two second vertical plates 51, and the two second vertical plates 51 are respectively located at the inner and outer sides of the lower surface of the second transverse plate 52. Preferably, the two first vertical plates 41 and the first transverse plate 42 are formed by integral bending, and the two second vertical plates 51 and the second transverse plate 52 are formed by integral bending.

Figure 18:
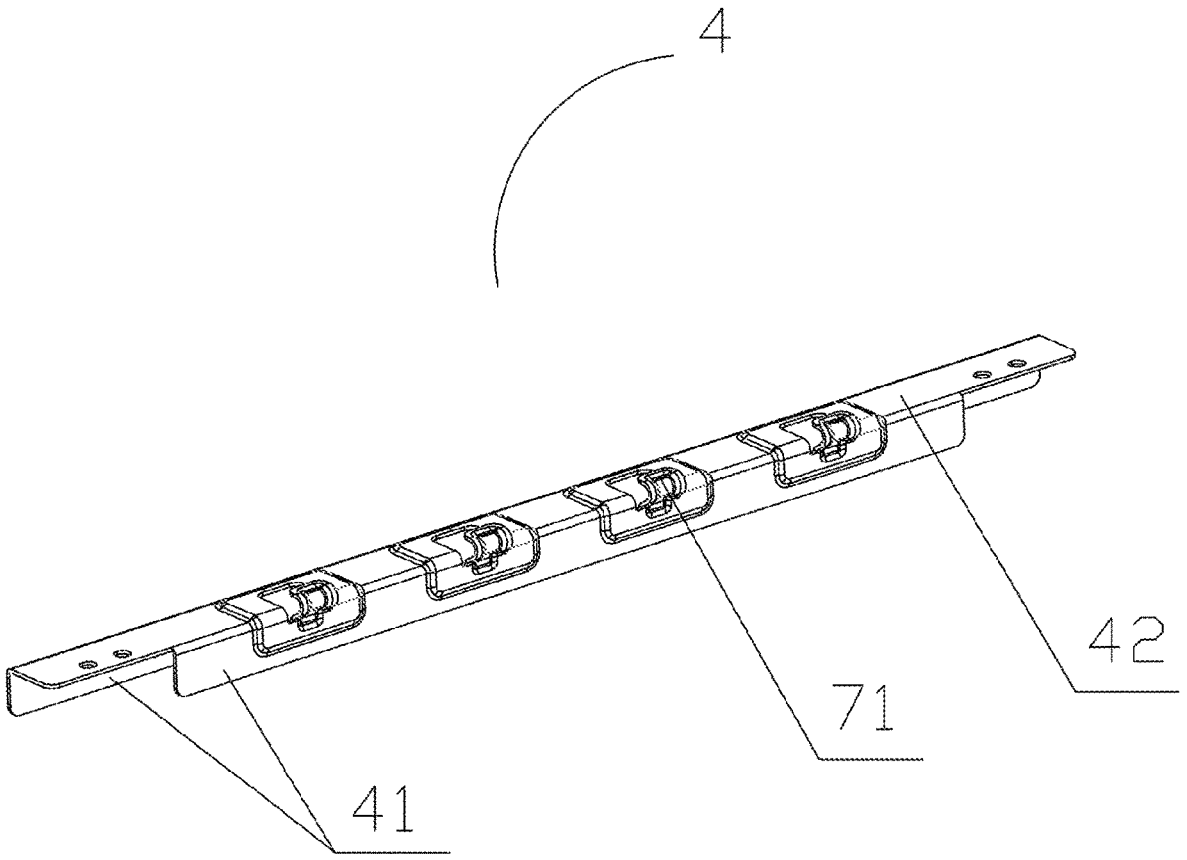
FIG. 18 and FIG. 19 are schematic diagrams showing a structure of a front rod shown in FIG. 16.
Figure 19:
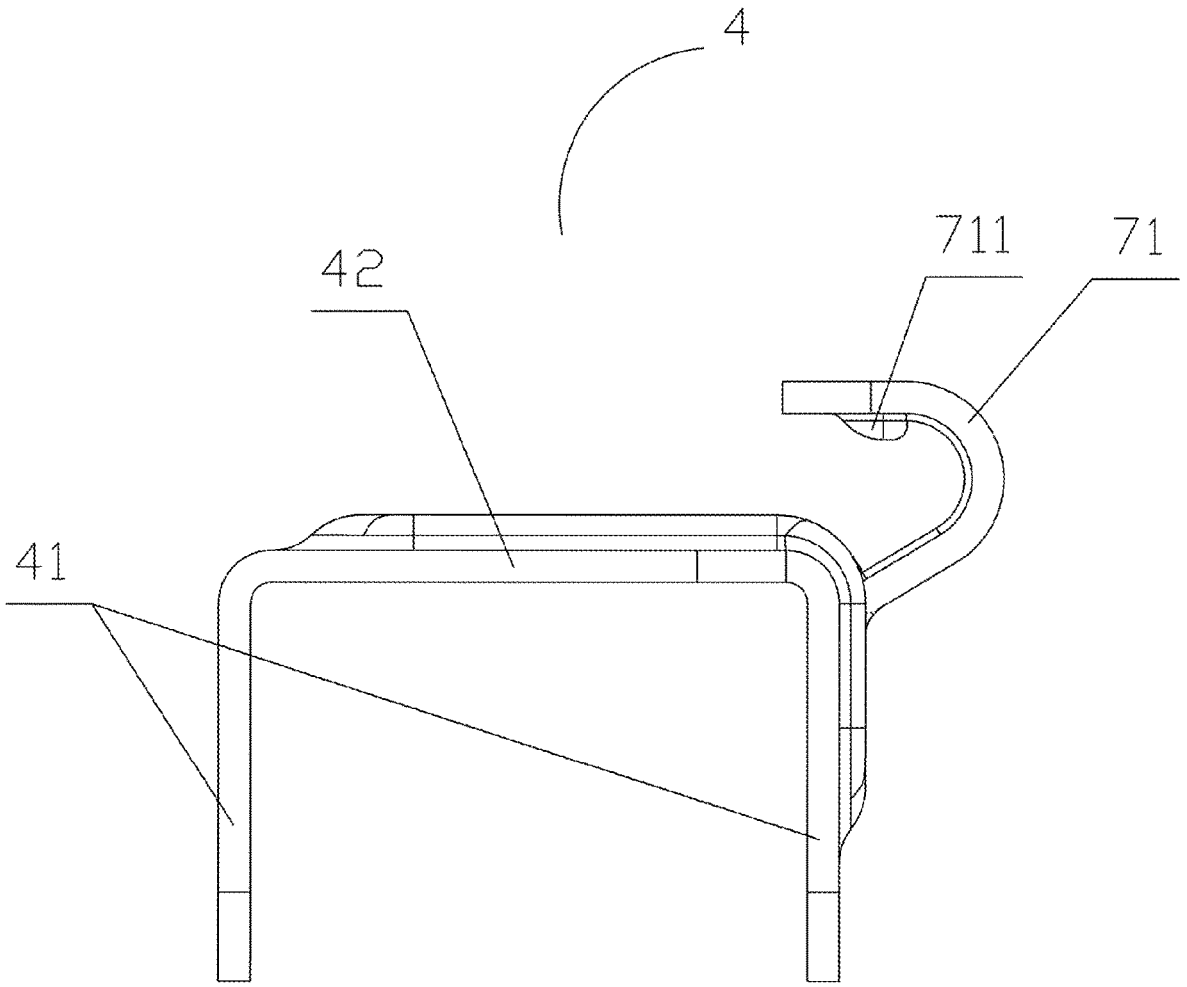

Referring to FIG. 18 and FIG. 19, specifically, the hooks 71 are approximately C-shaped, and the several hooks 71 on the front rod 4 are uniformly disposed on the second transverse plate 52 along the length direction of the front rod 4, preferably, the hooks 71 are integrally formed by punching the second transverse plate 52.

Figure 20:
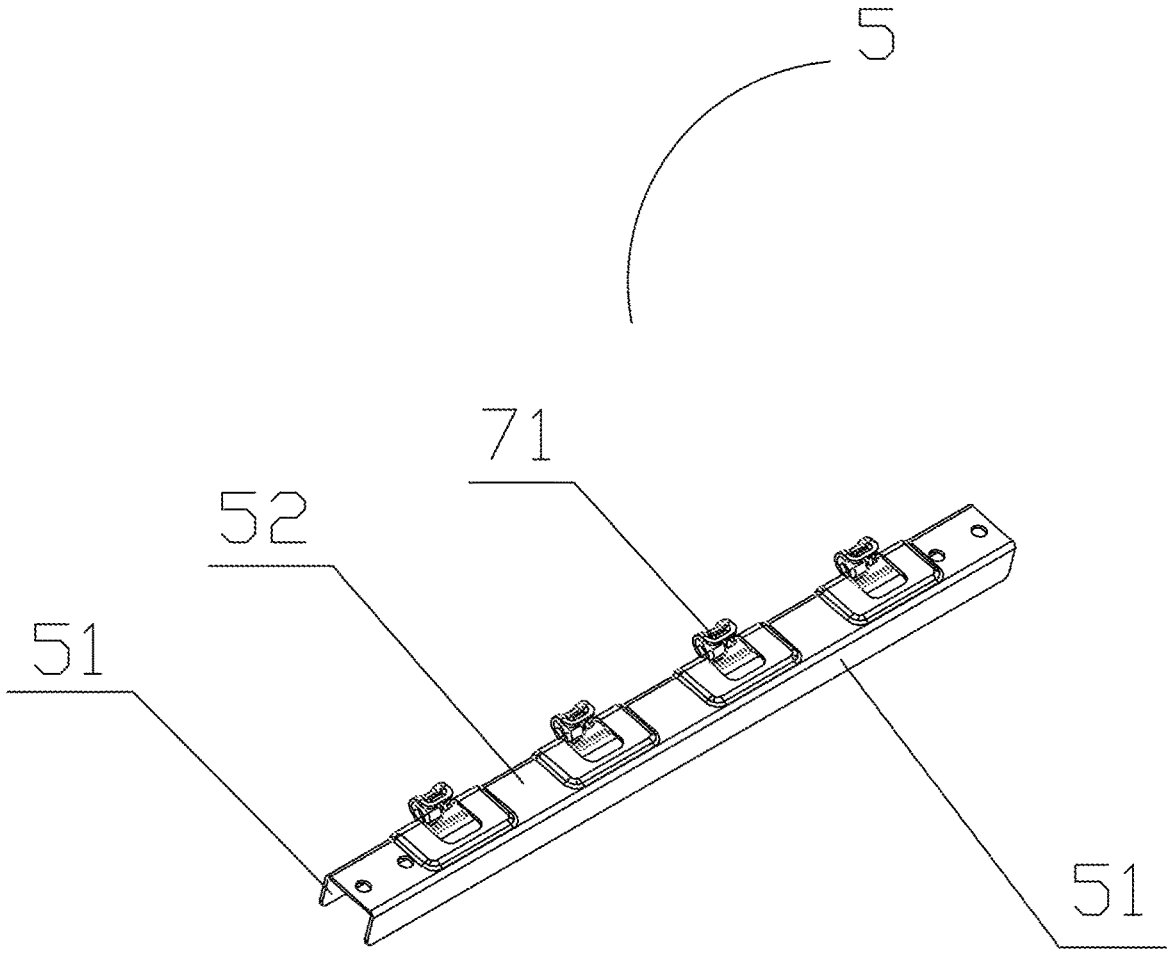
FIG. 20 and FIG. 21 are schematic diagrams showing a structure of a rear rod shown in FIG. 16.
Figure 21:
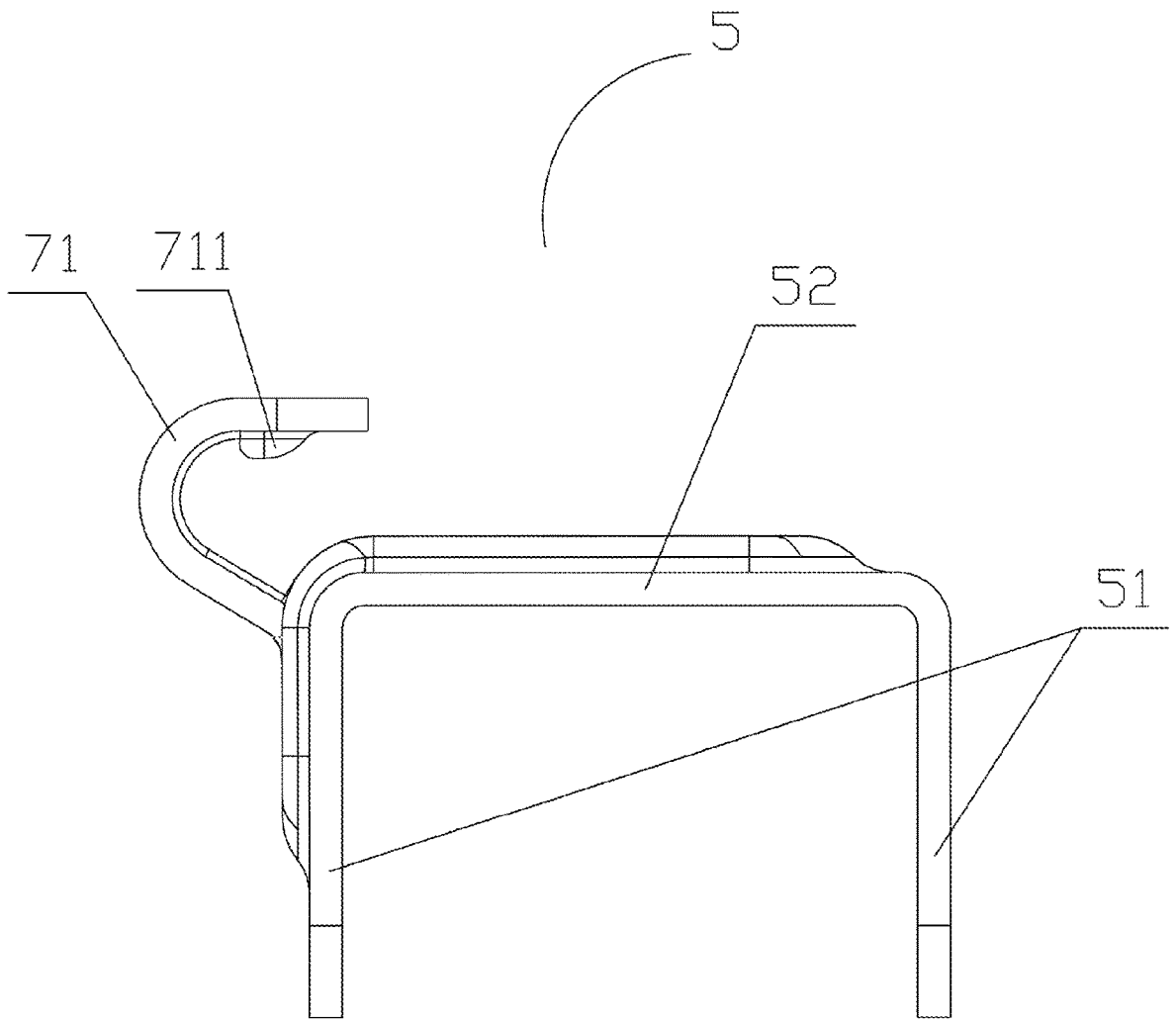

Referring to FIG. 20 and FIG. 21, the several hooks 71 on the rear rod 5 are uniformly disposed on the second transverse plate 52 along the length direction of the rear rod 5, preferably, the hooks 71 are integrally formed by punching the second transverse plate 52.

Therefore, compared with hooks connected to a cross beam in a welding or any other form in the prior art, the hooks 71 integrally formed by punching the transverse plates on the front rod 4 and the rear rod 5 are higher in strength and not easier to damage under the pulling force of the serpentine springs 6, so that the service life of the overall sofa is prolonged, the assembling process is simplified, and the step of welding the hooks is omitted.

Referring to FIG. 19 and FIG. 21, in the present embodiment, the hooks 71 are provided with bulges 711 for limiting the separation of the serpentine springs 6. When the serpentine spring 6 is hooked on two corresponding hooks 71, due to the arrangement of the bulges 711 on the two hooks 71, the serpentine spring 6 may be prevented from separating from the hooks 71 during use. Moreover, when the serpentine springs 6 are hooked and assembled, it is unnecessary to bend ends of the serpentine springs 6 to strength the connection with the hooks, so that assembling steps of the serpentine springs 6 are reduced, and the production efficiency is increased.

Specifically, the bulges 711 are disposed above the inner walls of C-shaped hook cavities of the hooks 71.

When the soft package is required to be fixed by using the front rod 4 and the rear rod 5, connecting pieces on a sofa fabric may be snapped on the lower edges of the first vertical plates 41 at the outer side of the first transverse plate 42 and the second vertical plates 51 at the outer side of the second transverse plate 52 so that the front rod 4 and the rear rod 5 are connected with the soft package.

Embodiment 7

Figure 22:
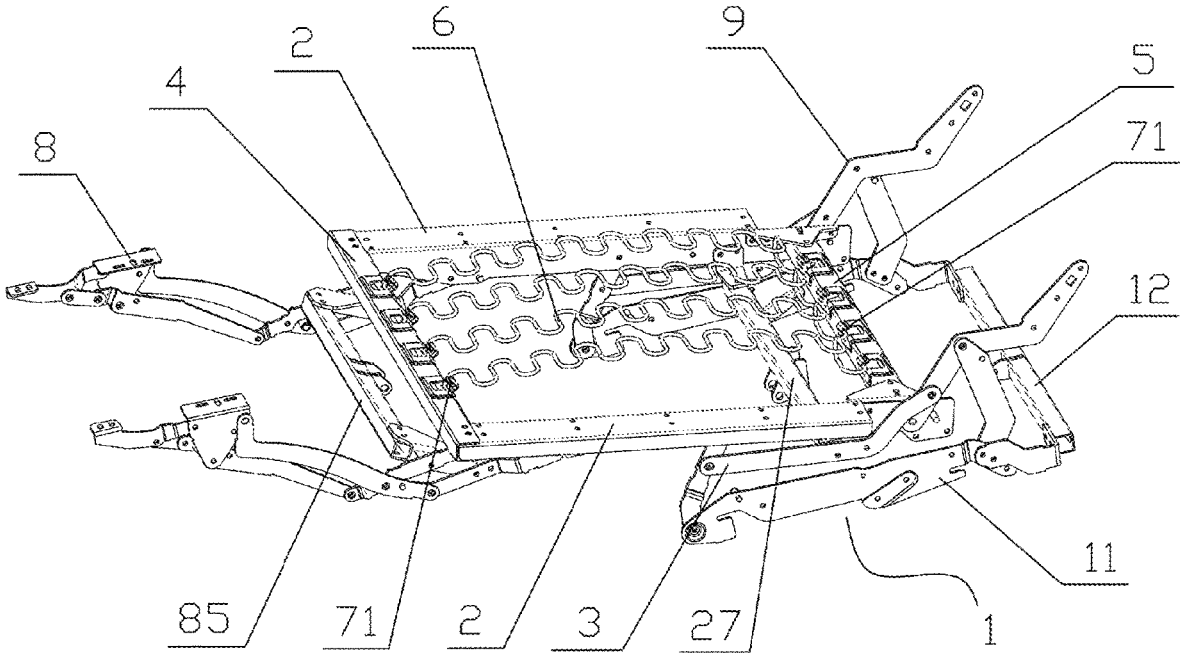
FIG. 22 is a schematic diagram showing a structure in embodiment 7 of the present invention.
Figure 23:
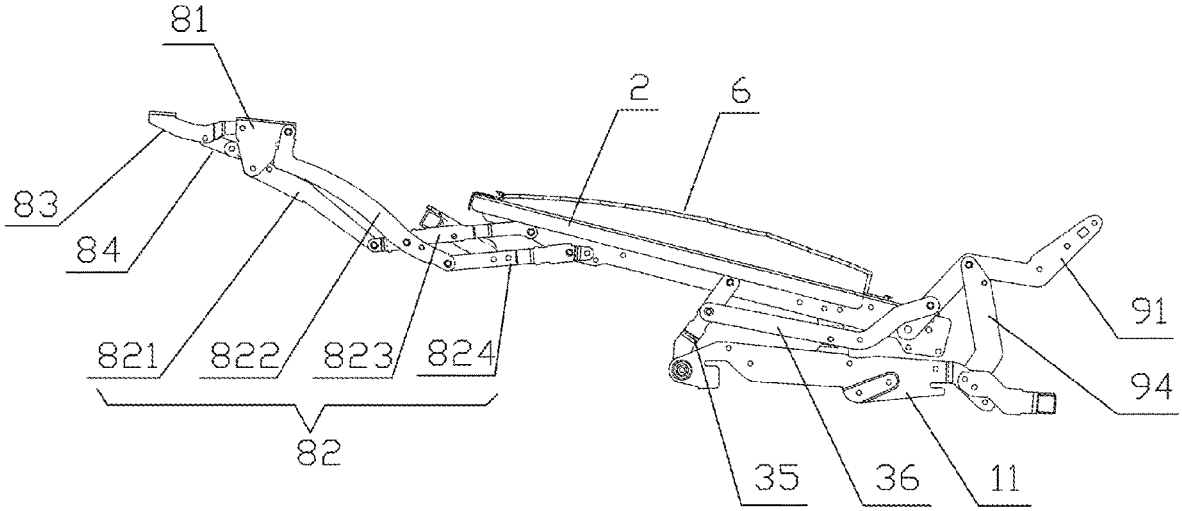
FIG. 23 is a schematic diagram showing a structure when an iron sofa frame structure shown in FIG. 22 is located on an extended position.
Figure 24:
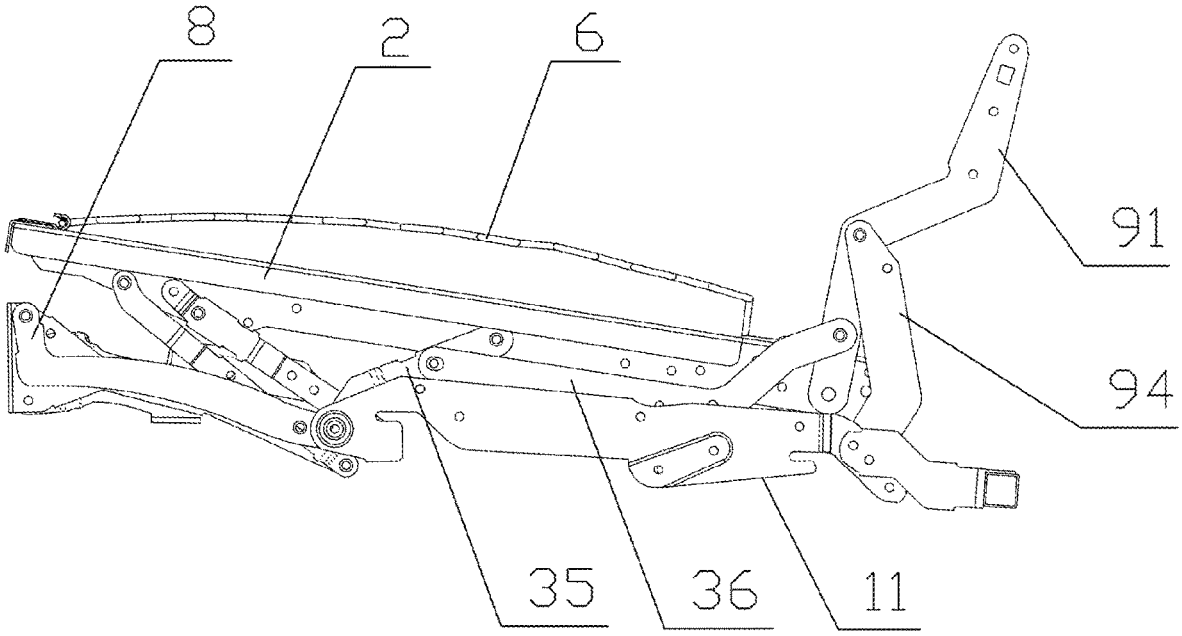
FIG. 24 is a schematic diagram showing a structure when the iron sofa frame structure shown in FIG. 22 is located on a retracted position.

Referring to FIG. 22 to FIG. 24, an iron sofa frame structure in the present embodiment is different from the structure in embodiment 1 in that the adopted driving link sets 3 and backrest assemblies 9 have different structure and are specifically described as follows:

each of the driving link sets 3 includes a ninth link 35 and a tenth link 36, each of the backrest assemblies 9 includes a backrest bracket 91 and a fixed link 94, two ends of the ninth link 35 are respectively hinged to the supporting plate 2 and the base 1, two ends of the tenth link 36 are respectively hinged to the ninth link 35 and the backrest bracket 91, the tail end of the backrest bracket 91 is hinged with the supporting plate 2, the head end of the backrest bracket 91 is upward and is configured to be connected with the backrest frame of the sofa, one end of the fixed link 94 is fixedly connected with the base 1, and the other end of the fixed link 94 is hinged with the backrest bracket 91.

Specifically, the backrest bracket 91 in the present embodiment is approximately Z-shaped and specifically includes a first connection part used as a head end, a second connection part and a third connection part as a tail end, which are connected in sequence, wherein the first connection part is configured to be connected with the backrest frame of the sofa, the second connection part is hinged with one end of the fixed link 94, and the end of the third connection part is hinged with the inner side plate 21 of the supporting plate 2.

In the present embodiment, one end of the fixed link 94 is hinged with the second connection part, and the other end of the fixed link 94 is fixedly connected with one end of a fixed mounting plate 11 in the base 1. Therefore, the backrest bracket 91 may rotate around a hinge point of the fixed link 94 and the second connection part.

In the present embodiment, one end of the ninth link 35 is hinged with an inner side plate 21 of each of the supporting plate 2, and the other end of the ninth link 35 is hinged with the other end of the fixed mounting plate 11 in the base 1. One end of the tenth link 36 is hinged with any position of a middle section of the third connection part of the backrest bracket 91, and the other end of the tenth link 36 is hinged with any position of a middle section of the ninth link 35. Therefore, each of the supporting plates 2, the ninth link 35, the tenth link 36 and the backrest bracket 91 form a four-link mechanism. Preferably, the four-link mechanism is a contra-parallelogram mechanism, and therefore, a position of a hinge point of the fixed link 94 and the backrest bracket 91 is higher than that of the tenth link 36 and the backrest bracket 91.

Referring to FIG. 23, when the supporting plates 2 move forwards relative to the base 1, the backrest bracket 91 is driven to be inclined backwards (that is, tilted backwards) under the cooperation of the above-mentioned contra-parallelogram mechanism.

For the drinking link sets 3 and the backrest assemblies 9 in embodiment 1, the number of parts of the iron frame in the present invention is obviously reduced as compared with that in the prior art, so that the difficulty of a production process is greatly lowered; and the links are simple in structure, so that external sizes of functional mechanisms in the iron sofa frame structure are reduced, the height of the iron frame is reduced, the occupied space is reduced, the comfort level is improved, and the aesthetic property of the overall sofa is improved.

Referring to FIG. 22, in the present embodiment, an intermediate cross rod 27 is further fixedly connected between the two supporting plates 2. Moreover, a first electric push rod and a second electric push rod are disposed in the iron sofa frame structure of the present embodiment, two ends of the first electric push rod are respectively connected with the intermediate cross rod 27 and a front motor driving rod 85, and two ends of the second electric push rod are respectively connected with the intermediate cross rod 27 and a rear motor driving rod 12.

Referring to FIG. 23 and FIG. 24, under the drive of the first electric push rod and the second electric push rod, a mechanical motion process of each link in the present embodiment is described as follows: during mechanical extension, a main footrest link 81 moves forwards under the drive of the first electric push rod, in such a process, a fourth telescoping link 824 and a third telescoping link 823 act forwards and drive a second telescoping link 822 and a first telescoping link 821; when the first telescoping link 821 moves forwards, an auxiliary footrest link 83 is lifted by an auxiliary footrest driving link 84, so that each of leg telescoping assemblies 8 is unfolded in three stages. After each link of each of the leg telescoping assemblies 8 is unfolded, the second electric push rod starts to drive the intermediate cross rod 27 to lift each of the supporting plates 2, so that the use comfort level of a user is improved. In an extension process that each of the supporting plates 2 lifts upwards and forwards, the ninth link 35 lifts upwards and forwards with the supporting plate 2, and the tenth link 36 slightly lifts upwards and forwards with the ninth link 35 and drives the backrest bracket 91 to be inclined backwards (that is, tilted backwards).

Embodiment 8

The present embodiment discloses a sofa with the iron sofa frame structure disclosed in embodiment 1, or embodiment 6 or embodiment 7, and the sofa further includes a soft package disposed on the iron sofa frame structure and a sofa fabric wrapping the surface of the soft package. In the present embodiment, connecting pieces are sewn on the sofa fabric, a connection between an iron frame and the soft package is completed by a detachable connection between each of the connecting pieces and a mating piece of the supporting assembly, and the soft package in the present embodiment generally adopts sponge, and leather or cloth is adopted as the sofa fabric.

In order to match with the iron sofa frame structure in embodiment 1, or embodiment 6 or embodiment 7, the connecting pieces in the present embodiment adopt U-shaped snap bars which are made of a hard material such as metal with the addition of a magnetic material so as to be automatically adsorbed in place.

There is no doubt that the soft further includes a backrest frame, a footrest frame and two armrest frames, wherein the backrest frame is disposed on the two backrest assemblies 9, the footrest frame is disposed on the two leg telescoping assemblies 8, and the two armrest frames are respectively mounted at the left and right sides of the iron sofa frame structure (that is, the left and right sides of the seating surface of the iron sofa frame structure).

The footrest frame telescopically moves between a retraction position and an extension position relative to the iron sofa frame structure, the backrest frame obliquely moves between a basically upright position and a backwards inclined position relative to the iron sofa frame structure, and the bottoms of the armrest frames are landed to play a supporting role.

In the present embodiment, two fixed mounting plates 11 of the base 1 may be respectively configured to be fixedly connected to the two armrest frames to play a role in fixing the base 1, so that the soft package may extend and retract relative to the armrest frames.

Admittedly, in other preferred embodiments, the base 1 may be further fixedly mounted on an existing sofa bottom supporting seat or directly supported on the ground to play a role in fixing the base 1, so that the soft package may extend and retract relative to the base 1 and the armrest frames.

Embodiment 9

The present embodiment discloses a sofa with the iron sofa frame structure disclosed in embodiment 2, or embodiment 3 or embodiment 4 or embodiment 5. In order to match with the iron frame structure in embodiment 2, or embodiment 3 or embodiment 4 or embodiment 5, in the present embodiment, snaps serving as connecting pieces are sewn on a soft package. During assembly, the snaps go around under the supporting plates 2 and are inserted into snap holes 24 in the supporting plates 2 to realize snapping, and thus, a connection between an iron frame and the soft package is completed.

Embodiment 10

Figure 25:
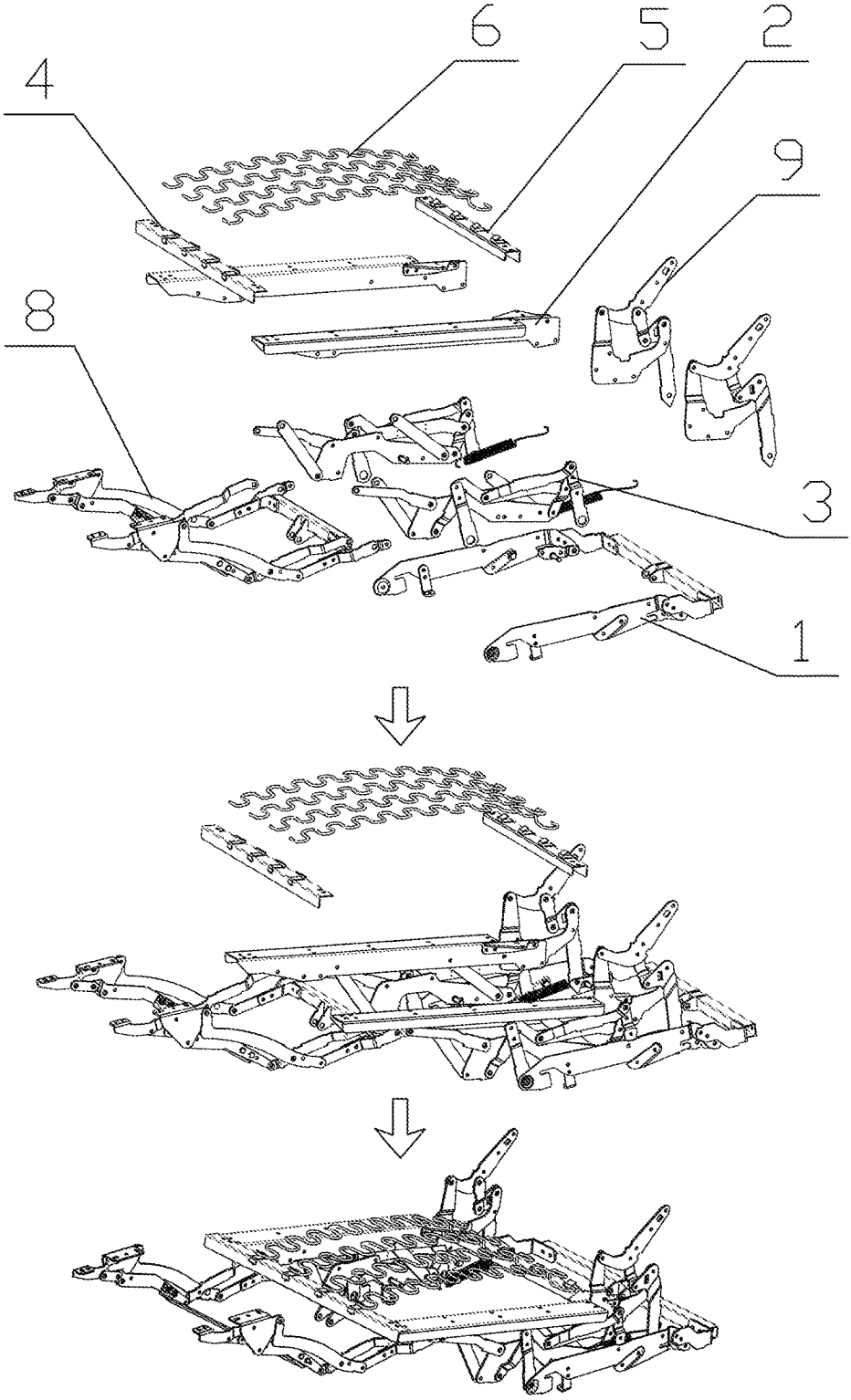
FIG. 25 is a schematic diagram showing the assembly of an iron sofa frame structure shown in embodiment 8 or 9 of the present invention.

The present embodiment discloses a production method of the sofa in embodiment 8 or embodiment 9, specifically including the following steps:

Referring to FIG. 25, an iron sofa frame structure is produced according to a limited size and is assembled to obtain the iron sofa frame structure. The step specifically includes: a base 1, two supporting plates 2 and two driving link sets 3 are produced according to limited sizes and are assembled to obtain a functional rack of an iron sofa frame; a front rod 4 and a rear rod 5 are produced according limited sizes, and the front rod 4 and the rear rod 5 are correspondingly disposed between the two supporting plates 2 at intervals to obtain the iron sofa frame, wherein the two supporting plates 2 are interconnected with the front rod 4 and the rear rod 5 to form a supporting assembly frame for supporting a soft package.

Elastic bearing pieces are mounted on the iron sofa frame structure.

The elastic bearing pieces are mounted between the front rod 4 and the rear rod 5, and the two supporting plates 2, the front rod 4, the rear rod 5 and the elastic bearing pieces form a supporting assembly for supporting the soft package; and preferably, the elastic bearing pieces are serpentine springs 6, and the serpentine springs 6 are detachably fixed on the front rod 4 and the rear rod 5 by fixing mechanisms 7.

Upsides of the elastic bearing pieces on the iron sofa frame are wrapped with a soft package.

Specifically, the soft package is generally sponge, the middle of the bottom of the soft package is provided with a groove matched with a spring surface formed by the elastic bearing pieces, and two sides of the bottom of the soft package are respectively abutted with the upper surfaces of the two supporting plates 2.

A sofa fabric is processed according to a set size, connecting pieces are fixed at edges of the sofa fabric, then, the sofa fabric is mounted on the soft package and is fixed on the iron sofa frame by using the connecting pieces to complete the production of a sofa cushion part; and preferably, the connecting pieces are sewn on the edge of the sofa fabric.

Specifically, the connecting pieces are respectively in snap connection to the two supporting plates 2. When the soft in embodiment 8 is produced, the connecting pieces are preferably U-shaped snap bars, and the snap bars are respectively snapped on lower edges of two outer side plates 22, so that a leather upholstering process of the sofa fabric is realized. During leather upholstering, the snap bars may also be snapped on the lower edges of first vertical plates 41 of the front rod 4 and second vertical plates 51 of the rear rod 5 so that the front rod 4 and the rear rod 5 are connected with the soft package, so that the soft package is more firmly connected with the supporting assembly frame, and the sofa fabric wrapping the soft package may be subjected to leather upholstering more closely and beautifully. When the soft in embodiment 9 is produced, the connecting pieces are preferably snaps, and the snaps are respectively snapped in snap holes 24 of the two outer side plates 22, so that a leather upholstering process of the sofa fabric is realized. During leather upholstering, U-shaped snap bars may be further mounted on positions, corresponding to the front rod 4 and the rear rod 5, of the sofa fabric, and the snap bars are respectively snapped on the lower edges of first vertical plates 41 of the front rod 4 and second vertical plates 51 of the rear rod 5 so that the front rod 4 and the rear rod 5 are connected with the soft package, so that the soft package is more firmly connected with the supporting assembly frame, and the sofa fabric wrapping the soft package may be subjected to leather upholstering more closely and beautifully.

Backrest assemblies and leg telescoping assemblies of the sofa are mounted on the iron sofa frame to complete the production of the sofa.

The production method of the sofa, provided by the present invention, breaks the production and assembly concepts of a traditional sofa, the two supporting plates 2 respectively hinged to one end of each of the two driving link sets 3 are combined with the front rod 4 and the rear rod 5 to form the supporting assembly frame, then, the supporting assembly frame is provided with the serpentine springs 6 to form the supporting assembly, and the supporting assembly is directly combined to the iron sofa frame, so that a structure in which an additional seat-wrapped frame is introduced to support the soft package is rejected, an existing iron sofa frame structure and a production process of the iron sofa frame are simplified, the assembling and production efficiencies are increased, materials are saved, the cost is reduced, and thus, the production method is suitable for industrial assembly line mass production.

The technical means disclosed by the solutions of the present invention are not only limited to the technical means disclosed in the above-mentioned implementations, but further include technical solutions formed by arbitrarily combining the above-mentioned technical features. It should be noted that several improvements and modifications may be further made by the ordinary skill in the art without departing from the principle of the present invention, and these improvements and modifications are also regarded to fall within the protective scope of the present invention.

The invention claimed is:

1. An iron sofa frame structure, characterized by comprising:

a base (1), two supporting plates (2) oppositely disposed, configured to support a soft package and be connected with a sofa fabric and two driving link sets (3) respectively configured to connect the two supporting plates (2) to the base (1), wherein a front rod (4) and a rear rod (5) are correspondingly disposed at intervals between the two supporting plates (2), and several elastic bearing pieces configured to bear the soft package are disposed between the front rod (4) and the rear rod (5).

2. The iron sofa frame structure according to claim 1, characterized in that the supporting plates (2) are hinged to the driving link sets (3).

3. The iron sofa frame structure according to claim 2, characterized in that each of the supporting plates (2) comprises a panel (23) for supporting the soft package and an inner side plate (21) disposed on the panel (23), and the inner side plate (21) is provided with several hinge points (26) for hinging the driving link set (3).

4. The iron sofa frame structure according to claim 3, characterized by further comprising two oppositely disposed backrest assemblies (9), wherein the backrest assemblies (9) are connected to the base (1) and the inner side plates (21).

5. The iron sofa frame structure according to claim 4, characterized in that each of the driving link sets (3) comprises a ninth link (34) and a tenth link (35), each of the backrest assemblies (9) comprises a backrest bracket (91) configured to be connected with a backrest frame of the sofa and a fixed link (94), two ends of the ninth link (34) are respectively hinged to the inner side plate (21) and the base (1), two ends of the tenth link (35) are respectively hinged to the ninth link (34) and the backrest bracket (91), one end of the backrest bracket (91) is hinged with the inner side plate (21), one end of the fixed link (94) is fixedly connected with the base (1), and an other end of the fixed link (94) is hinged with the backrest bracket (91).

6. The iron sofa frame structure according to claim 3, characterized by further comprising two oppositely disposed leg telescoping assemblies (8), wherein the leg telescoping assemblies (8) are connected to the inner side plates (21).

7. The iron sofa frame structure according to claim 3, characterized in that a width of the panel (23) is greater than 5 cm.

8. The iron sofa frame structure according to claim 3, characterized in that the inner side plate (21) is further provided with snap holes (24) configured to connect connecting pieces on the sofa fabric.

9. The iron sofa frame structure according to claim 3, characterized in that the inner side plate (21) and the panel (23) are inverted L-shaped, and the inner side plate (21) and the panel (23) are formed by integral bending.

10. The iron sofa frame structure according to claim 3, characterized in that the panel (23) is further provided with an outer side plate (22) for connecting the connecting pieces on the sofa fabric, and the inner side plate (21) and the outer side plate (22) are respectively located at the inner and outer sides of a lower surface of the panel (23).

11. The iron sofa frame structure according to claim 10, characterized in that the inner side plate (21), the outer side plate (22) and the panel (23) are inverted U-shaped, and the inner side plate (21), the outer side plate (22) and the panel (23) are formed by integral bending.

12. The iron sofa frame structure according to claim 1, characterized in that the elastic bearing pieces are serpentine springs (6), and the serpentine springs (6) are detachably fixed on the front rod (4) and the rear rod (5) by fixing mechanisms (7).

13. The iron sofa frame structure according to claim 12, characterized in that each of the fixing mechanisms (7) comprises a fixed end (73) and a hook end (72) which are connected, an outer side wall of each of the front rod (4) and the rear rod (5) is provided with several holes (43) for inserting and fixing the fixed ends (73), the fixed ends (73) of the fixing mechanisms (7) are inserted into the holes (43) of the front rod (4) or the rear rod (5) so as to be fixed, and the hook ends (72) are disposed on an upper surface of the front rod (4) or the rear rod (5) and are connected with the serpentine springs (6).

14. The iron sofa frame structure according to claim 13, characterized in that each of the fixed ends (73) is of a Z-shaped structure.

15. The iron sofa frame structure according to claim 12, characterized in that the fixing mechanisms (7) are hooks (71), and the hooks (71) are respectively and correspondingly disposed on the front rod (4) and the rear rod (5) and are connected with the serpentine springs (6).

16. The iron sofa frame structure according to claim 15, characterized in that the hooks (71) are provided with bulges (711) for limiting separation of the serpentine springs (6).

17. The iron sofa frame structure according to claim 15, characterized in that the front rod (4) is made of a metal material, the front rod (4) comprises two oppositely disposed first vertical plates (41) and a first transverse plate (42) connected with the two first vertical plates (41), and the hooks (71) on the front rod (4) are formed by integrally punching the first transverse plate (42).

18. The iron sofa frame structure according to claim 17, characterized in that the two first vertical plates (41) and the first transverse plate (42) are inverted U-shaped and are formed by integral bending.

19. The iron sofa frame structure according to claim 15, characterized in that the rear rod (5) is made of a metal material, the rear rod (5) comprises two oppositely disposed second vertical plates (51) and a second transverse plate (52) connected with the two second vertical plates (51), and the hooks (71) on the rear rod (5) are formed by integrally punching the second transverse plate (52).

20. The iron sofa frame structure according to claim 19, characterized in that the two second vertical plates (51) and the second transverse plate (52) are inverted U-shaped and are formed by integral bending.

21. A sofa, characterized by comprising:

an iron sofa frame structure, wherein the iron sofa frame structure is provided with a base (1), two supporting plates (2) oppositely disposed, configured to support a soft package and be connected with a sofa fabric, two driving link sets (3) respectively configured to connect the two supporting plates (2) to the base (1), two backrest assemblies (9) oppositely disposed and configured to connect the base (1) and the supporting plates (2) and two leg telescoping assemblies (8) oppositely disposed and connected to the supporting plates (2), a front rod (4) and a rear rod (5) are correspondingly disposed at intervals between the two supporting plates (2), and several elastic bearing pieces for bearing the soft package are disposed between the front rod (4) and the rear rod (5);

the soft package, disposed on the elastic bearing pieces;

the sofa fabric, wrapping surface of the soft package and being in snap connection with the two supporting plates (2);

a backrest frame, disposed on the two backrest assemblies (9);

a footrest frame, disposed on the two leg telescoping assemblies (8); and two armrest frames, respectively disposed at left and right sides of the iron sofa frame structure.

22. The sofa according to claim 21, characterized in that the supporting plates (2) are hinged to the driving link sets (3).

23. The sofa according to claim 22, characterized in that each of the supporting plates (2) comprises a panel (23) for supporting the soft package and an inner side plate (21) disposed on the panel (23), and the inner side plate (21) is provided with several hinge points (26) for hinging the driving link set (3).

24. The sofa according to claim 23, characterized in that each of the leg telescoping assemblies (8) comprises a main footrest link (81) and a leg link set (82), and the main footrest link (81) is hinged to the inner side plate (21) by the leg link set (82).

25. The sofa according to claim 23, characterized in that each of the backrest assemblies (9) comprises a backrest bracket (91), a backrest supporting bracket (92) and a backrest link set (93), and the backrest bracket (91) is connected to the inner side plate (21) and the base (1) by the backrest supporting bracket (92) and the backrest link set (93).

26. The sofa according to claim 23, characterized in that each of the driving link sets (3) comprises a ninth link (34) and a tenth link (35), each of the backrest assemblies (9) comprises a backrest bracket (91) and a fixed link (94) which are connected with the backrest frame of the sofa, two ends of the ninth link (34) are respectively hinged to the inner side plate (21) and the base (1), two ends of the tenth link (35) are respectively hinged to the ninth link (34) and the backrest bracket (91), one end of the backrest bracket (91) is hinged with the inner side plate (21), one end of the fixed link (94) is fixedly connected with the base (1), and an other end of the fixed link (94) is hinged with the backrest bracket (91).

27. The sofa according to claim 23, characterized in that edges of the sofa fabric are provided with several connecting pieces configured to be in snap connection with the two supporting plates (2).

28. The sofa according to claim 27, characterized in that the connecting pieces are snaps or snap bars.

29. The sofa according to claim 27, characterized in that the inner side plate (21) is further provided with snap holes (24) for connecting the connecting pieces.

30. The sofa according to claim 27, characterized in that the panel (23) is further provided with an outer side plate (22), the inner side plate (21) and the outer side plate (22) are respectively located at the inner and outer sides of a lower surface of the panel (23), and the connecting pieces are snapped on a lower edge of the outer side plate (22).

31. The sofa according to claim 21, characterized in that the elastic bearing pieces are serpentine springs (6), and the serpentine springs (6) are detachably fixed on the front rod (4) and the rear rod (5) by fixing mechanisms (7).

32. The sofa according to claim 31, characterized in that each of the fixing mechanisms (7) comprises a fixed end (73) and a hook end (72) which are connected, an outer side wall of each of the front rod (4) and the rear rod (5) is provided with several holes (43) for inserting and fixing the fixed ends (73), the fixed ends (73) of the fixing mechanisms (7) are inserted into the holes (43) of the front rod (4) or the rear rod (5) so as to be fixed, and the hook ends (72) are disposed on an upper surface of the front rod (4) or the rear rod (5) and are connected with the serpentine springs (6).

33. The sofa according to claim 31, characterized in that the fixing mechanisms (7) are hooks (71), and the hooks (71) are respectively and correspondingly disposed on the front rod (4) and the rear rod (5) and are connected with the serpentine springs.

34. The sofa according to claim 33, characterized in that the hooks (71) are provided with bulges (711) for limiting separation of the serpentine springs (6).

35. The sofa according to claim 33, characterized in that each of the front rod (4) and the rear rod (5) is made of a metal material, the front rod (4) comprises two oppositely disposed first vertical plates (41) and a first transverse plate (42) connected with the two first vertical plates (41), the rear rod (5) comprises two oppositely disposed second vertical plates (51) and a second transverse plate (52) connected with the two second vertical plates (51), the hooks (71) on the first transverse plate (42) are formed by integrally punching the first transverse plate (42), and the hooks (71) on the second transverse plate (52) are formed by integrally punching the second transverse plate (52).

* * * * *